US010068432B2

(12) United States Patent
Wortmann

(10) Patent No.: US 10,068,432 B2
(45) Date of Patent: Sep. 4, 2018

(54) GAMING MACHINE WITH SYMBOL PROPAGATION

(71) Applicant: Pridefield Limited, Douglas, Isle of Man (GB)

(72) Inventor: Jonathan B. Wortmann, Ballarat (AU)

(73) Assignee: Pridefield Limited, Douglas, Isle of Man (GB)

( * ) Notice: Subject to any disclaimer, the term of this patent is extended or adjusted under 35 U.S.C. 154(b) by 0 days.

(21) Appl. No.: 15/487,869

(22) Filed: Apr. 14, 2017

(65) Prior Publication Data

US 2017/0316649 A1 Nov. 2, 2017

(30) Foreign Application Priority Data

Apr. 28, 2016 (GB) ..... 1607374.4

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/3227* (2013.01);
(Continued)

(58) Field of Classification Search
CPC ..... G07F 17/3211; G07F 17/3213
See application file for complete search history.

(56) References Cited

U.S. PATENT DOCUMENTS 5,704,835 A 1/1998 Dietz, II
6,251,013 B1 * 6/2001 Bennett ..... G07F 17/3211 273/143 R (Continued)

FOREIGN PATENT DOCUMENTS

AU 2003246319 10/2003
AU 2011253848 A1 1/2014

(Continued)

OTHER PUBLICATIONS

European Patent Office, Extended European Search Report dated Jun. 6, 2017, issued in connection with Application No. EP 17153144.5, 9 pages.

(Continued)

*Primary Examiner* — Steven J Hylinski
(74) *Attorney, Agent, or Firm* — McDonnell Boehnen Hulbert & Berghoff LLP

(57) ABSTRACT

An embodiment may involve selecting a set of symbols associated with an outcome event of a reel-based game. The reel-based game may be executed on behalf of a client machine, and selecting the set of symbols may involve spinning a plurality of reels to determine the outcome event. The embodiment may further involve determining that the set of symbols includes a predetermined symbol on a designated reel and does not include any winning combination. The embodiment may also involve, possibly in response to determining that the set of symbols includes the predetermined symbol on the designated reel and does not include any winning combination, replacing one or more symbols in the set of symbols with predetermined symbols such that the symbol set after replacement includes a winning combination.

20 Claims, 16 Drawing Sheets

(52) U.S. Cl.
CPC ..... *G07F 17/3244* (2013.01); *G07F 17/3265* (2013.01); *G07F 17/3267* (2013.01); *G07F 17/34* (2013.01)

(56) References Cited

U.S. PATENT DOCUMENTS

| | | | | |
|---|---|---|---|---|
| 6,379,248 | B1 | 4/2002 | Jorasch et al. | |
| 6,439,993 | B1 * | 8/2002 | O'Halloran | G07F 17/3265 273/143 R |
| 6,561,904 | B2 | 5/2003 | Locke et al. | |
| 6,712,697 | B2 | 3/2004 | Acres | |
| 6,743,102 | B1 | 6/2004 | Fiechter et al. | |
| 6,855,054 | B2 | 2/2005 | White et al. | |
| 6,939,228 | B2 | 9/2005 | Shimizu | |
| 7,063,617 | B2 | 6/2006 | Brosnan et al. | |
| 7,090,580 | B2 | 8/2006 | Rodgers et al. | |
| 7,237,775 | B2 | 7/2007 | Thomas et al. | |
| 7,331,862 | B2 | 2/2008 | Rodgers et al. | |
| 7,331,866 | B2 | 2/2008 | Rodgers et al. | |
| 7,331,867 | B2 | 2/2008 | Baelocher et al. | |
| 7,341,518 | B2 | 3/2008 | Muskin | |
| 7,393,278 | B2 | 7/2008 | Gerson et al. | |
| 7,850,521 | B2 | 12/2010 | Rodgers et al. | |
| 7,857,695 | B2 | 12/2010 | Rodgers et al. | |
| 7,950,994 | B2 | 5/2011 | Berman et al. | |
| 8,430,743 | B2 | 4/2013 | Moshal | |
| 8,734,237 | B2 | 5/2014 | Moshal | |
| 9,224,270 | B2 | 12/2015 | Lee et al. | |
| 9,659,456 | B2 * | 5/2017 | Van Linden | G07F 17/3265 |
| 9,830,780 | B2 | 11/2017 | Cuddy et al. | |
| 9,934,646 | B2 | 4/2018 | Igesund | |
| 9,959,703 | B2 | 5/2018 | Igesund | |
| 9,997,012 | B2 | 6/2018 | Wortmann et al. | |
| 2002/0039920 | A1 | 4/2002 | Bryant | |
| 2002/0045474 | A1 | 4/2002 | Singer et al. | |
| 2002/0068623 | A1 * | 6/2002 | Gauselmann | G07F 17/3265 463/20 |
| 2002/0151359 | A1 | 10/2002 | Rowe | |
| 2003/0064810 | A1 | 4/2003 | Okada | |
| 2003/0155715 | A1 | 8/2003 | Walker et al. | |
| 2003/0162585 | A1 | 8/2003 | Bigelow et al. | |
| 2003/0162588 | A1 | 8/2003 | Brosnan et al. | |
| 2004/0032086 | A1 | 2/2004 | Barragan | |
| 2004/0097280 | A1 * | 5/2004 | Gauselmann | G07F 17/3239 463/16 |
| 2004/0242312 | A1 * | 12/2004 | Gomez | G07F 17/32 463/20 |
| 2004/0254011 | A1 | 12/2004 | Muskin | |
| 2004/0259640 | A1 | 12/2004 | Gentles et al. | |
| 2005/0010715 | A1 | 1/2005 | Davies et al. | |
| 2005/0054420 | A1 * | 3/2005 | Cregan | G07F 17/3265 463/20 |
| 2005/0153778 | A1 | 7/2005 | Nelson et al. | |
| 2005/0170883 | A1 | 8/2005 | Muskin | |
| 2005/0239545 | A1 * | 10/2005 | Rowe | G07F 17/32 463/29 |
| 2006/0084494 | A1 | 4/2006 | Belger et al. | |
| 2006/0264254 | A1 | 11/2006 | Aoki | |
| 2006/0281525 | A1 * | 12/2006 | Borissov | G07F 17/3265 463/20 |
| 2007/0026933 | A1 * | 2/2007 | Tanimura | G07F 17/32 463/20 |
| 2007/0054732 | A1 | 3/2007 | Baerlocher | |
| 2007/0060303 | A1 | 3/2007 | Govender et al. | |
| 2007/0060314 | A1 | 3/2007 | Baerlocher et al. | |
| 2007/0060317 | A1 | 3/2007 | Martin | |
| 2007/0167226 | A1 | 7/2007 | Kelly et al. | |
| 2007/0287529 | A1 * | 12/2007 | Kojima | G07F 17/32 463/20 |
| 2008/0039171 | A1 | 2/2008 | Slomiany et al. | |
| 2008/0070673 | A1 | 3/2008 | Bennett et al. | |
| 2008/0076574 | A1 | 3/2008 | Okada | |
| 2008/0113742 | A1 | 5/2008 | Amos et al. | |
| 2008/0108411 | A1 | 8/2008 | Jensen et al. | |
| 2008/0287178 | A1 | 11/2008 | Berman et al. | |
| 2009/0054129 | A1 | 2/2009 | Yoshimura et al. | |
| 2009/0069071 | A1 * | 3/2009 | Aoki | G07F 17/34 463/20 |
| 2009/0104979 | A1 | 4/2009 | Ruymann | |
| 2009/0131145 | A1 | 5/2009 | Aoki et al. | |
| 2009/0156303 | A1 | 6/2009 | Kiely et al. | |
| 2009/0227356 | A1 | 9/2009 | Moroney | |
| 2009/0305769 | A1 * | 12/2009 | Plowman | G07F 17/32 463/20 |
| 2009/0305770 | A1 * | 12/2009 | Bennett | G07F 17/32 463/20 |
| 2010/0004048 | A1 | 1/2010 | Brito | |
| 2010/0004050 | A1 | 1/2010 | Caputo et al. | |
| 2010/0022297 | A1 | 1/2010 | Saunders | |
| 2010/0056249 | A1 | 3/2010 | Yamauchi | |
| 2010/0120525 | A1 | 5/2010 | Baerlocher et al. | |
| 2010/0197377 | A1 | 8/2010 | Aoki et al. | |
| 2011/0028202 | A1 | 2/2011 | Naicker et al. | |
| 2011/0117987 | A1 * | 5/2011 | Aoki | G07F 17/32 463/20 |
| 2012/0015713 | A1 | 1/2012 | Cannon | |
| 2012/0122546 | A1 | 5/2012 | Lange | |
| 2012/0122547 | A1 * | 5/2012 | Aoki | G07F 17/34 463/20 |
| 2012/0244928 | A1 | 9/2012 | Visser | |
| 2012/0258787 | A1 | 10/2012 | Bennett | |
| 2012/0276980 | A1 | 11/2012 | Moroney | |
| 2012/0295688 | A1 | 11/2012 | Watkins et al. | |
| 2013/0023329 | A1 * | 1/2013 | Saunders | G07F 17/34 463/20 |
| 2013/0143635 | A1 | 6/2013 | Arora et al. | |
| 2013/0157733 | A1 * | 6/2013 | Thorne | G07F 17/3227 463/1 |
| 2013/0184047 | A1 | 7/2013 | Haykin et al. | |
| 2014/0066169 | A1 | 3/2014 | Watkins et al. | |
| 2014/0179400 | A1 | 6/2014 | Lee | |
| 2014/0323198 | A1 | 10/2014 | Tuck | |
| 2015/0248810 | A1 | 9/2015 | Wortmann et al. | |
| 2015/0248811 | A1 | 9/2015 | Wortmann et al. | |
| 2015/0287276 | A1 | 10/2015 | Humphrey et al. | |
| 2015/0363999 | A1 | 12/2015 | Little | |
| 2016/0104345 | A1 | 4/2016 | MacGregor et al. | |
| 2016/0351005 | A1 | 12/2016 | Igesund | |
| 2016/0351006 | A1 | 12/2016 | Igesund | |
| 2017/0213416 | A1 | 7/2017 | Wortmann | |
| 2017/0316648 | A1 | 11/2017 | Wortmann | |
| 2017/0316651 | A1 | 11/2017 | Wortmann et al. | |
| 2018/0122182 | A1 | 5/2018 | Wortmann | |
| 2018/0122183 | A1 | 5/2018 | Wortmann | |
| 2018/0122184 | A1 | 5/2018 | Wortmann | |
| 2018/0122189 | A1 | 5/2018 | Wortmann | |

FOREIGN PATENT DOCUMENTS

| | | | |
|---|---|---|---|
| AU | 2013251288 | 5/2014 | |
| CA | 2827968 | 3/2014 | |
| CA | 2868773 | 4/2015 | |
| EP | 1351180 | 10/2003 | |
| EP | 2615591 | 3/2013 | |
| EP | 2713347 | 4/2014 | |
| EP | 2866211 | 4/2015 | |
| EP | 2894612 | 7/2015 | |
| EP | 2916299 | 9/2015 | |
| GB | 2139390 | 11/1984 | |
| GB | 2393018 A * | 3/2004 | G07F 17/3244 |
| WO | 2002/41963 | 5/2002 | |
| WO | 2006/027677 | 3/2006 | |

OTHER PUBLICATIONS

Australian Government, IP Australia, Examination Report No. 1 dated Mar. 28, 2017, issued in connection with Australian Patent Application No. 2016202966, 2 pages.

Australian Government, IP Australia, Examination Report No. 1 dated Mar. 29, 2017, issued in connection with Australian Patent Application No. 2016202965, 3 pages.

(56) References Cited

OTHER PUBLICATIONS

Australian Government, IP Australia, Patent Examination Report No. 1, dated Dec. 20, 2012, issued in connection with Australian Patent Application No. 2011253848, 4 pages.
Canadian Intellectual Property Office, Examiner's Report dated Dec. 7, 2016, issued in connection with CA Application No. 2929222, 3 pages.
Canadian Intellectual Property Office, Office Action dated Mar. 13, 2017, issued in connection with Canadian Patent Application No. 2929218, 6 pages.
Canadian Intellectual Property Office, Examiner's Report dated Feb. 5, 2013, issued in connection with CA Application No. 27602112, 2 pages.
European Patent Office, European Search Report dated Jul. 27, 2016, issued in connection with EP Application No. 16171834.1, 8 pages.
European Patent Office, European Search Report dated Jun. 28, 2016, issued in connection with EP Application No. 16171832.5, 8 pages.
European Patent Office, Extended European Search Report dated Feb. 24, 2012, issued in connection with EP Application No. 11194636.4, 6 pages.
European Patent Office, Extended European Search Report dated Oct. 26, 2010, issued in connection with EP Application No. 10251152.4, 8 pages.
European Patent Office, Supplementary European Search Report dated Oct. 8, 2008, issued in connection with EP Application No. 05789874.4, 6 pages.
Final Office Action dated Sep. 14, 2012, issued in connection with U.S. Appl. No. 12/511,391, filed Jul. 29, 2009, 14 pages.
Final Office Action dated Jun. 23, 2010, issued in connection with U.S. Appl. No. 10/550,744, filed Aug. 24, 2006, 13 pages.
Final Office Action dated Sep. 28, 2009, issued in connection with U.S. Appl. No. 10/550,744, filed Aug. 24, 2006, 11 pages.
Intellectual Property Office, Combined Search Report and Abbreviated Examination Report dated Nov. 29, 2016, issued in connection with Application No. GB1509339.6, 7 pages.
Intellectual Property Office, Combined Search Report and Abbreviated Examination Report dated Nov. 29, 2016, issued in connection with Application No. GB1509340.4, 7 pages.
International Bureau, International Preliminary Report on Patentability dated Mar. 13, 2007, issued in connection with International Application No. PCT/IB2005/002678, filed on Sep. 9, 2005, 4 pages.
International Searching Authority, International Search Report and Written Opinion dated Jan. 16, 2007, issued in connection with International Application No. PCT/IB2005/002678, filed on Sep. 9, 2005, 8 pages.
Non-Final Office Action dated Apr. 4, 2008, issued in connection with U.S. Appl. No. 10/550,744, filed Aug. 24, 2006, 8 pages.
Non-Final Office Action dated Dec. 10, 2012, issued in connection with U.S. Appl. No. 12/974,690, filed Dec. 21, 2009, 25 pages.
Non-Final Office Action dated Dec. 24, 2009, issued in connection with U.S. Appl. No. 10/550,744, filed Aug. 24, 2006, 12 pages.
Non-Final Office Action dated Mar. 29, 2012, issued in connection with U.S. Appl. No. 12/511,391, filed Jul. 29, 2009, 10 pages.
Non-Final Office Action dated Nov. 29, 2013, issued in connection with U.S. Appl. No. 13/856,124, filed Apr. 3, 2013, 19 pages.
Non-Final Office Action dated Jul. 31, 2013, issued in connection with U.S. Appl. No. 13/856,124, filed Apr. 3, 2013, 19 pages.
Notice of Allowability dated Nov. 26, 2010, issued in connection with U.S. Appl. No. 10/550,744, filed Aug. 24, 2006, 4 pages.
Notice of Allowance dated Apr. 10, 2014, issued in connection with U.S. Appl. No. 13/856,124, filed Apr. 3, 2013, 7 pages.
Notice of Allowance dated Mar. 11, 2013, issued in connection with U.S. Appl. No. 12/974,690, filed Dec. 21, 2009, 14 pages.
Wortman, Jonathan, U.S. Appl. No. 15/392,946, filed Dec. 28, 2016, 44 pages.
Australian Government, IP Australia, Examination Report No. 2 dated Jul. 14, 2017, issued in connection with Australian Patent Application No. 2016202966, 6 pages.
Australian Government, IP Australia, Notice of Acceptance dated Sep. 25, 2013, issued in connection with Australian Patent Application No. 2011253848, 2 pages.
Australian Government, IP Australia, Examination Report No. 4 dated Mar. 9, 2018, issued in connection with Australian Patent Application No. 2016202966, 3 pages.
Australian Australian Government, IP Australia, Examination Report No. 2 dated Mar. 6, 2018, issued in connection with Australian Patent Application No. 2017200271, 3 pages.
Australian Australian Government, IP Australia, Examination Report No. 3 dated Jun. 5, 2018, issued in connection with Australian Patent Application No. 2017200271, 3 pages.
Australian Australian Government, IP Australia, Examination Report No. 2 dated May 11, 2018, issued in connection with Australian Patent Application No. 2017202474, 4 pages.
Australian Australian Government, IP Australia, Examination Report No. 2 dated May 14, 2018, issued in connection with Australian Patent Application No. 2017202574, 4 pages.
Australian Australian Government, IP Australia, Examination Report No. 2 dated May 14, 2018, issued in connection with Austrialian Patent Application No. 2017202577, 3 pages.
Australian Australian Government, IP Australia, Examination Report No. 2 dated May 14, 2018, issued in connection with Australian Patent Application No. 2017202579, 4 pages.
Australian Australian Government, IP Australia, Examination Report No. 1 dated Mar. 20, 2018, issued in connection with Australian Patent Application No. 2017235913, 2 pages.
Australian Australian Government, IP Australia, Examination Report No. 1 dated Mar. 6, 2018, issued in connection with Australian Patent Application No. 2017235921, 2 pages.
Australian Australian Government, IP Australia, Examination Report No. 1 dated Mar. 6, 2018, issued in connection with Australian Patent Application No. 2017235939, 2 pages.
Australian Australian Government, IP Australia, Examination Report No. 1 dated Mar. 6, 2018, issued in connection with Australian Patent Application No. 2017235945, 2 pages.
Canadian aanadian Intellectual Property Office, Examiner's Report dated Feb. 6, 2014, issued in connection with Canadian Patent Application No. 2,760,112, 3 pages.
Canadian Intellectual Property Office, Examiner's Report dated Mar. 18, 2015, issued in connection with Canadian Patent Application No. 2,760,112, 6 pages.
Canadian Intellectual Property Office, Final Office Action dated Dec. 2, 2016, issued in connection with Canadian Patent Application No. 2,760,112, 5 pages.
Canadian Intellectual Property Office, Examiner's Report dated May 11, 2018, issued in connection with Canadian Patent Application No. 2,964,233, 5 pages.
Canadian Intellectual Property Office, Examiner's Report dated Mar. 29, 2018, issued in connection with Canadian Patent Application No. 2,964,558, 6 pages.
Canadian Intellectual Property Office, Examiner's Report dated May 11, 2018, issued in connection with Canadian Patent Application No. 2,964,587, 5 pages.
Canadian Intellectual Property Office, Examiner's Report dated Apr. 24, 2018, issued in connection with Canadian Patent Application No. 2,964,739, 5 pages.
European Patent Office, Office Action dated Sep. 10, 2013, issued in connection with EP Application No. 11194636.4, 5 pages.
United Kingdom Intellectual Property Office, Search Report dated Apr. 13, 2018, issued in connection with Great Britain Patent Application No. 1618347.7, 6 pages.
United Kingdom Intellectual Property Office, Search Report dated Apr. 17, 2018, issued in connection with Great Britain Patent Application No. 1618349.3, 7 pages.
United Kingdom Intellectual Property Office, Search Report dated Apr. 17, 2018, issued in connection with Great Britain Patent Application No. 1618352.7, 7 pages.

(56) References Cited

OTHER PUBLICATIONS

United Kingdom Intellectual Property Office, Search Report dated Apr. 13, 2018, issued in connection with Great Britain Patent Application No. 1618353.5, 6 pages.
Notice of Allowance dated Mar. 8, 2018, issued in connection with U.S. Appl. No. 15/140,945, filed Apr. 28, 2016, 5 pages.
Notice of Allowance dated Apr. 11, 2018, issued in connection with U.S. Appl. No. 15/485,984, filed Apr. 12, 2017, 7 pages.
Non-Final Office Action dated May 22, 2018, issued in connection with U.S. Appl. No. 15/487,022, filed Apr. 13, 2017, 12 pages.
Canadian Examination Report dated Mar. 29, 2018 for Canadian Application Serial No. 2,964,558, 6 pages.
Canadian Intellectual Property Office, Examiner's Report dated Jan. 16, 2018, issued in connection with Canadian Patent Application No. 2,929,218, 8 pages.
Australian Government, IP Australia, Examination Report No. 3 dated Nov. 21, 2017, issued in connection with Australian Patent Application No. 2016202966, 4 pages.
Notice of Allowance dated Dec. 20, 2017, issued in connection with U.S. Appl. No. 15/141,010, filed Apr. 28, 2016, 8 pages.
Australian Government, IP Australia, Examination Report No. 1 dated Oct. 14, 2017, issued in connection with Australian Patent Application No. 2017200271, 4 pages.
Canadian Intellectual Property Office, Examiner's Report dated Dec. 19, 2017, issued in connection with Canadian Patent Application No. 2,954,790, 3 pages.
United Kingdom Intellectual Property Office, Search Report dated Jun. 28, 2017, issued in connection with Great Britain Patent Application No. 1601306.2, 6 pages.
Australian Government, IP Australia, Examination Report No. 2 dated Jun. 26, 2017, issued in connection with Australian Patent Application No. 2016202965, 2 pages.
Australian Australian Government, IP Australia, Examination Report No. 3 dated Oct. 12, 2017, issued in connection with Australian Patent Application No. 2016202965, 3 pages.
Canadian Intellectual Property Office, Examiner's Report dated Dec. 19, 2017, issued in connection with Canadian Patent Application No. 2,929,222, 6 pages.
European Patent Office, Office Action dated Aug. 23, 2017, issued in connection with EP Application No. 16171832.5, 7 pages.
Non-Final Office Action dated Oct. 18, 2017, issued in connection with U.S. Appl. No. 15/140,945, filed Apr. 28, 2016, 12 pages.
Notice of Allowance dated Jan. 16, 2018, issued in connection with U.S. Appl. No. 15/140,945, filed Apr. 28, 2016, 5 pages.
Non-Final Office Action dated Feb. 20, 2018, issued in connection with U.S. Appl. No. 15/485,984, filed Apr. 12, 2017, 11 pages.
Notice of Allowance dated Feb. 13, 2018, issued in connection with U.S. Appl. No. 15/141,010, filed Apr. 28, 2016, 5 pages.
Australian Government, IP Australia, Examination Report No. 1 dated Jan. 30, 2018, issued in connection with Australian Patent Application No. 2017202577, 2 pages.
Australian Government, IP Australia, Examination Report No. 1 dated Jan. 30, 2018, issued in connection with Australian Patent Application No. 2017202579, 2 pages.
Australian Government, IP Australia, Examination Report No. 1 dated Jan. 30, 2018, issued in connection with Australian Patent Application No. 2017202474, 2 pages.
Australian Government, IP Australia, Examination Report No. 1 dated Jan. 30, 2018, issued in connection with Australian Patent Application No. 2017202574, 2 pages.
Australian Government, IP Australia, Examination Report No. 4 dated Feb. 19, 2018, issued in connection with Australian Patent Application No. 2016202965, 3 pages.
United Kingdom Intellectual Property Office, Search Report dated Aug. 16, 2017, issued in connection with Great Britain Patent Application No. 1607379.3, 6 pages.
United Kingdom Intellectual Property Office, Search Report dated Aug. 11, 2017, issued in connection with Great Britain Patent Application No. 1607380.1, 8 pages.

* cited by examiner

GAMING MACHINE WITH SYMBOL PROPAGATION

CROSS-REFERENCE TO RELATED APPLICATION

This application claims priority to U.K. patent application No. 1607374.4, filed Apr. 28, 2016, which is hereby incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For example, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine over the computer network. In this instance, the server machine may perform the spins of the game and may send the resulting symbols to the client machine for display.

The popularity of video slot games has increased due to the incorporation of novel features, such as a "Wild" symbol, into such games. A Wild symbol, which is usually the highest-ranking symbol of the game, offers line payouts, just like any other symbol and, additionally, substitutes for any other symbol in the game, thereby assisting in making winning results and providing a player with entertainment and additional opportunities to win games.

Viewed from a first aspect, the disclosure involves selecting a set of symbols associated with an outcome event of a reel-based game. The reel-based game may be executed on behalf of a client machine. Selecting the set of symbols may involve spinning a plurality of reels to determine the outcome event. A memory may store respective pluralities of symbols for the reels. The disclosure also involves storing the set of symbols in the memory. The disclosure further involves determining that the set of symbols includes a predetermined symbol on a designated reel and does not include any winning combination. The disclosure additionally involves, possibly in response to determining that the set of symbols includes the predetermined symbol on the designated reel and does not include any winning combination, replacing one or more symbols in the set of symbols with predetermined symbols. The symbol set after replacement may include a winning combination. The disclosure also involves storing the set of symbols after replacement in the memory.

Viewed from a second aspect, the disclosure provides an article of manufacture including a non-transitory computer-readable medium, having stored thereon program instructions that, upon execution by a gaming machine, cause the gaming machine to perform the operations of the first aspect.

Viewed from a third aspect, the disclosure provides a gaming machine configured to perform the operations of the first aspect.

Viewed from a fourth aspect, the disclosure provides a system comprising means for performing the operations of the first aspect.

Viewed from a fifth aspect, the disclosure provides a gaming system that comprises a plurality of gaming devices each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more gaming device processors; and one or more gaming device memory devices storing (i) respective pluralities of symbols for the reels and (ii) a plurality of gaming device instructions. The gaming device instructions may be executable by the one or more gaming device processors to perform the operations of the first aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A symbol displayed within a symbol-display-portion of a display during an outcome event may be replaced by another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines and methods for carrying out aspects of outcome events that include displaying symbols, such as games, in particular, wager games. In one aspect, the machines and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often maximize their profits simply by getting more players to play more games. Due to the provided feature, players may be drawn in (e.g., from competing casinos that lack games with such a feature) and they may play the game often. The feature can include new data communications between a server machine and a client machine within a server-client based configuration.

II. Example Architecture

Figure 1:
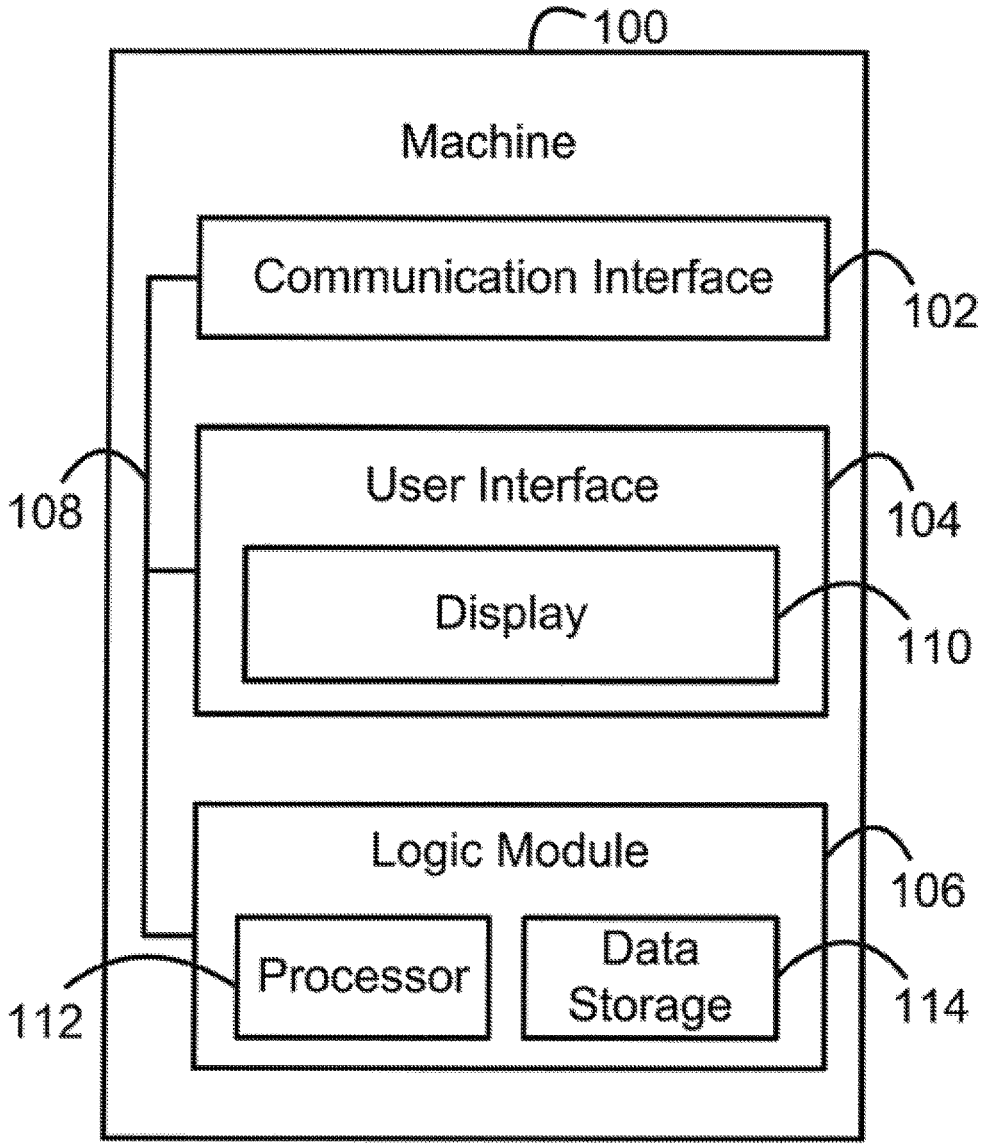
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad or a touch-sensitive screen. As described in greater detail below, display 110 may be configured to display, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
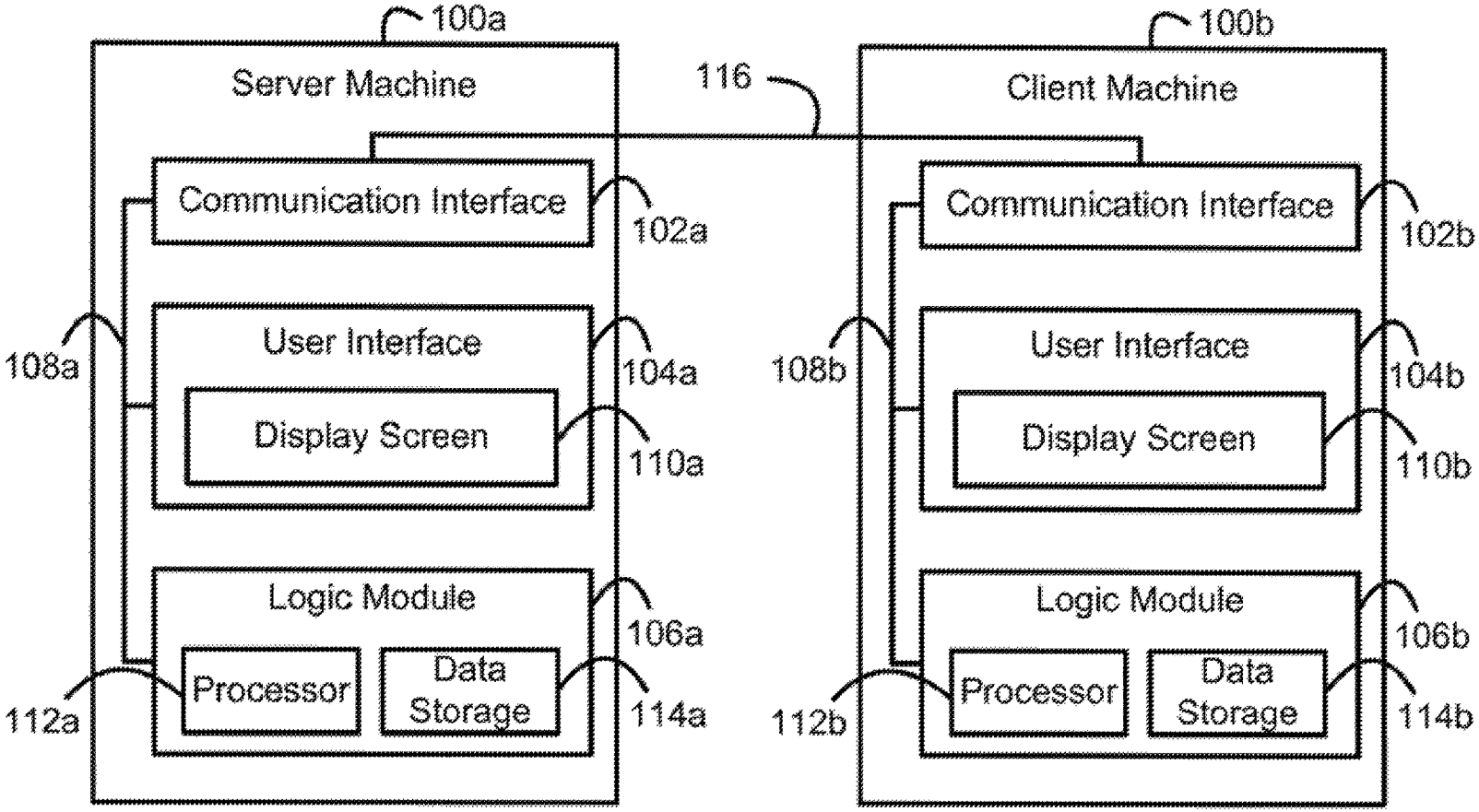
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a computer-network 116. A configuration of elements including server machine 100*a* and client machine 100*b* can be referred to as a server-client based configuration.

The components of the server machine 100*a* and the client machine 100*b* are shown with corresponding "a" and ""b" reference numerals (i.e., based on machine 100). Server machine 100*a* includes communication interface 102*a*, user interface 104*a* (which incorporates display screen 110*a*), logic module 106*a* (which incorporates processor 112*a* and data storage 114*a*), and communication bus 108*a*. Likewise, client machine 100*b* includes communication interface 102*b*, user interface 104*b* (which incorporates display screen 110*b*), logic module 106*b* (which incorporates processor 112*b* and data storage 114*b*), and communication bus 108*b*.

The server machine 100*a* is configured to communicate with the client machine 100*b* over the computer-network 116 (via the communication interfaces 102*a*, 102*b*). Likewise, the client machine 100*b* is configured to communicate with the server machine 100*a* over the computer-network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The computer-network 116 for the server-client based configuration described above may take a variety of forms. For example, the computer-network 116 may be a local area network (LAN) in a casino, such that client machines 100*b* dispersed throughout the casino may communicate with the server machine 100*a* in the casino.

In another example, the computer-network 116 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The computer-network 116 may include any of a variety of network topologies and network devices, and may employ traditional network-related technologies, including for example the public switched telephone network, cable networks, cellular wireless networks, WiFi, and WiMAX. Further, the computer-network 116 may include one or more databases (e.g., a player credit account database), to allow for the storing and retrieving of data related to performing an outcome event by a machine, as well as adjusting account balances associated with client machines.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Figure 5:
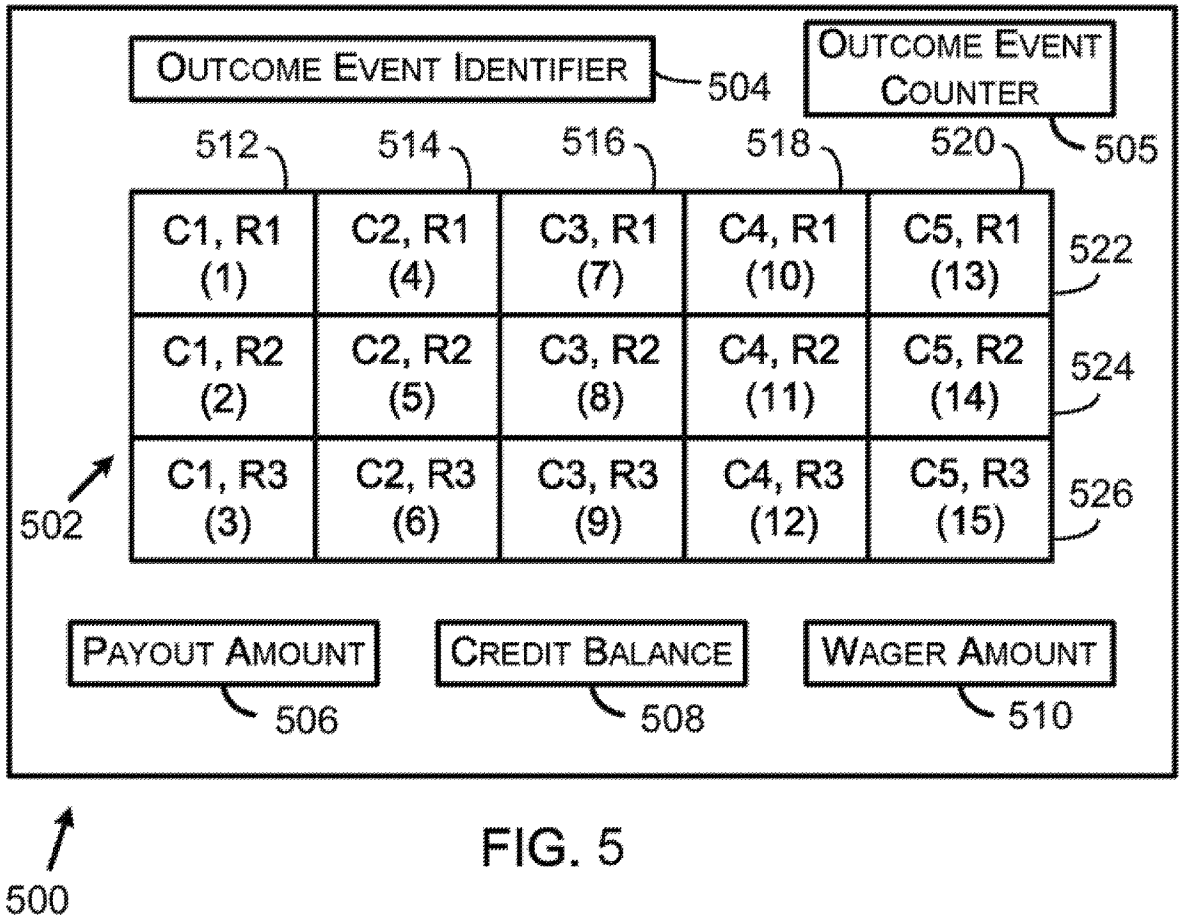
FIG. 5 depicts elements displayable by a display of a machine, in accordance with example embodiments.

Next, FIG. 5 depicts a screenshot 500 that machine 100, server machine 100*a*, or client machine 100*b* can visually present (i.e., display) using displays 110, 110*a*, and 110*b*, respectively. For purposes of this description, each element of screenshot 500 can be a displayable element of the display. Screenshot 500 includes a symbol-display-portion 502, an outcome event identifier 504, an outcome event counter 505, a payout amount indicator 506, a credit balance indicator 508, and a wager amount indicator 510.

Symbol-display-portion 502 can include multiple symbol-display-segments and multiple symbol positions. As an example, the symbol-display-segments can include vertical symbol-display-segments 512, 514, 516, 518, and 520 (or more simply, vertical SDS 512-520). As another example, the symbol-display-segments can include horizontal symbol-display-segments 522, 524, and 526 (or more simply, horizontal SDS 522-526). Each symbol-display-segment can include multiple symbol positions. The vertical SDS 512-520 are shown in FIG. 5 as having three symbol positions. The horizontal SDS 522-526 are shown in FIG. 5 as having five symbol positions. A person skilled in the art will understand that those symbol-display-segments can be configured with different numbers of symbol positions than shown in FIG. 5.

The vertical SDS 512-520 can be configured as spinnable reels. The processor of a machine or system displaying screenshot 500 can display the spinnable reels spinning and stopped after spinning. For vertical SDS 512-520, the spinnable reels may spin in a vertical direction (e.g., top to bottom or bottom to top, with respect to the symbol-display-portion 502).

The horizontal SDS 522-526 can be configured as spinnable reels. The processor of a machine or system displaying screenshot 500 can display the spinnable reels spinning and stopped after spinning. For horizontal SDS 522-526, the spinnable reels may spin in a horizontal direction (e.g., left to right or right to left, with respect to the symbol-display-portion 502).

The multiple symbol positions in symbol-display-portion 502 are identified by column and row designators, in which C1=column 1, C2=column 2, C3=column 3, C4=column 4, C5=column 5, R1=row 1, R2=row 2, and R3=row 3. The multiple symbol positions in symbol-display-portion 502 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 5, C2 is between C1 and C3, C3 is between C2 and C4, and C4 is between C3 and C5.

For a matrix arrangement with 15 symbol positions as shown in FIG. 5, the numerical identifiers can be whole numbers 1 through 15, inclusive. The processors or machines described herein can be configured to select a symbol position of symbol-display-portion 502 using a random number generator that is configured to generate a number within the range 1 through N, inclusive, where N equals the number of symbol positions in symbol-display-portion 502. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 504 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 510, the determined payout amount to be displayed by the payout amount indicator 506, the determined credit balance to be displayed by the credit balance indicator 508, and the number of awarded remaining outcome events to be displayed by the outcome event counter 505.

III. Example Operations

Figure 3:
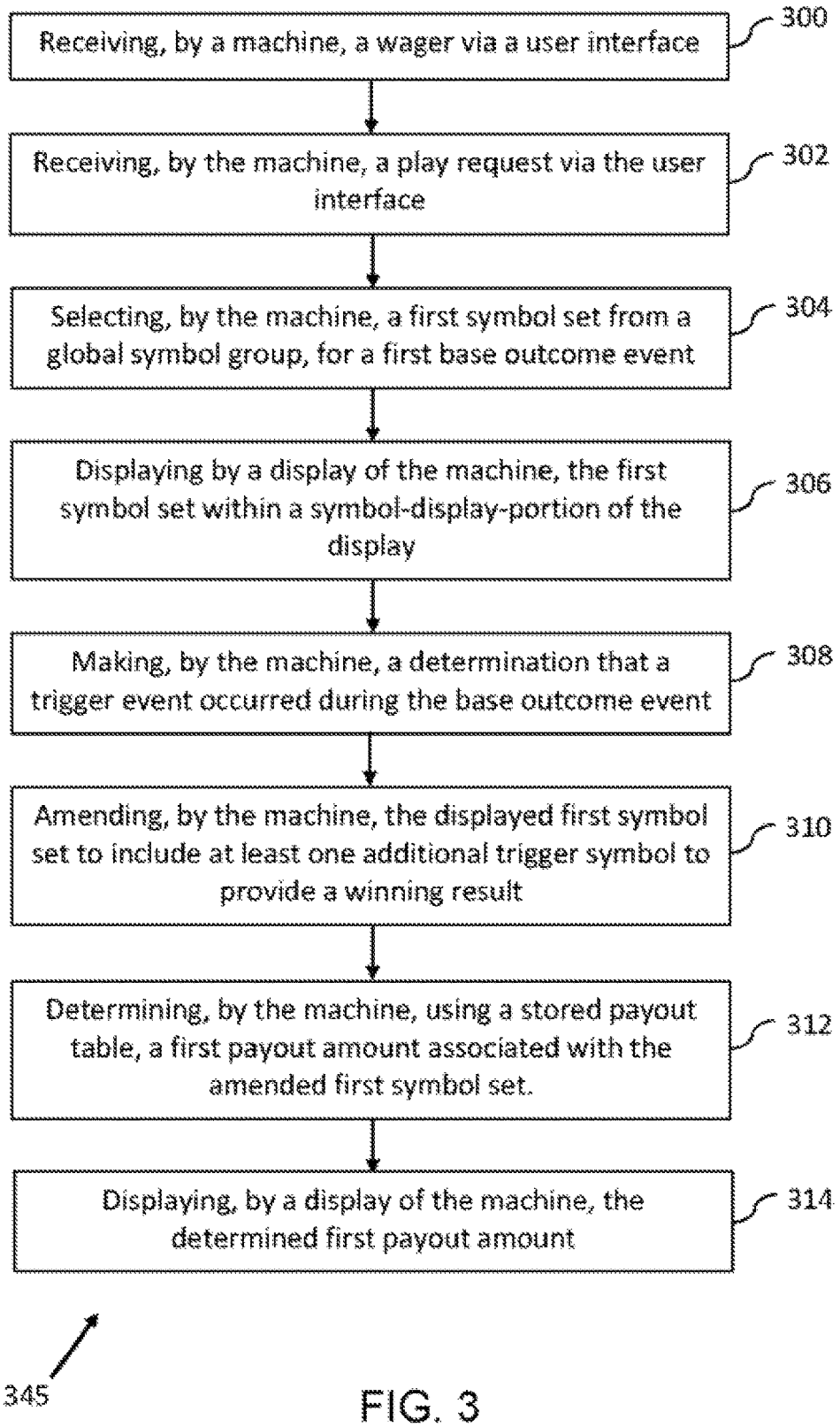
FIG. 3 is a flow chart, in accordance with example embodiments.

FIG. 3 depicts a flowchart showing a set of operations 345 (or more simply, "the set 345") that can, for example, be carried out using machine 100. Nonetheless, some or all of these operations may be carried out on server machine 100*a* and/or client machine 100*b*.

The operations of the set 345 are shown within blocks labeled with even integers between 300 and 314, inclusive, and can pertain to a method in connection with machine 100. The example method can relate to performing outcome events, such as a wager game. Any other operation(s) described herein as being performed by machine 100 can be performed prior to, while, or after performing any one or more of the operations of the set 345, unless context clearly dictates otherwise. Those other operation(s) can be performed in combination with or separately from any one or more of the operations of the set 345. Any operation described below, or elsewhere in this description, with respect to FIG. 3, can be performed, at least in part, by a processor, such as processor 112 executing software program instructions.

Turning to FIG. 3, block 300 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 508, possible wager amounts in wager amount indicator 510, and a received wager amount in wager amount indicator 510.

Next, block 302 includes receiving, by machine 100, a play request (e.g., a "spin" request) via the user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event.

Next, block 304 includes determining, by machine 100, a first symbol set to display within the symbol-display-portion 502 of display 110 for the outcome event. Determining the first symbol set can include processor 112 carrying out a random selection, such as a random selection of the first symbol set from a global symbol group.

Figure 6:
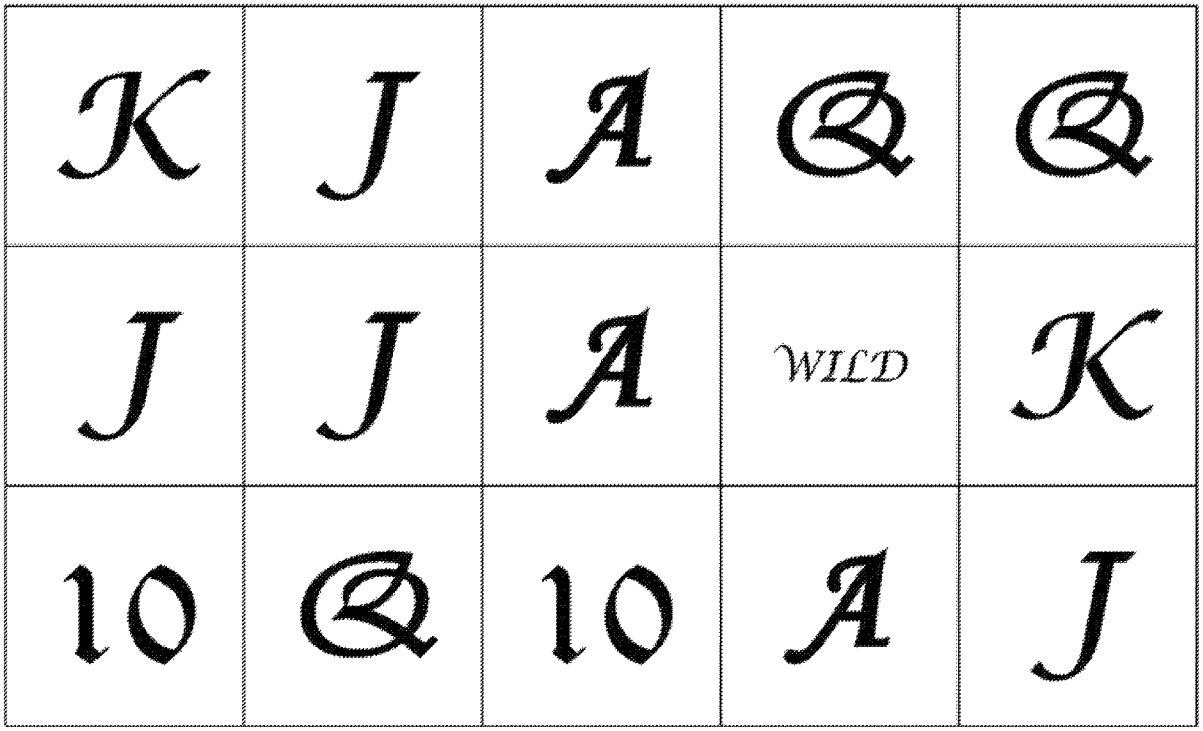
FIG. 6 depicts an example of a selected symbol set in a display, in accordance with example embodiments.

The global symbol group can include multiple symbols, such as a Wild, an Ace, a King, a Queen, a Jack and a Ten that may be used in connection with the outcome event, such as a wager game. The Ace, King, Queen, Jack and Ten symbols can represent symbols found on a standard deck of playing cards. FIG. 6 depicts examples of the aforementioned symbols and examples of other symbols that can be a part of the global symbol group. The global symbol group may be customized with particular symbols as desired.

Figure 4:
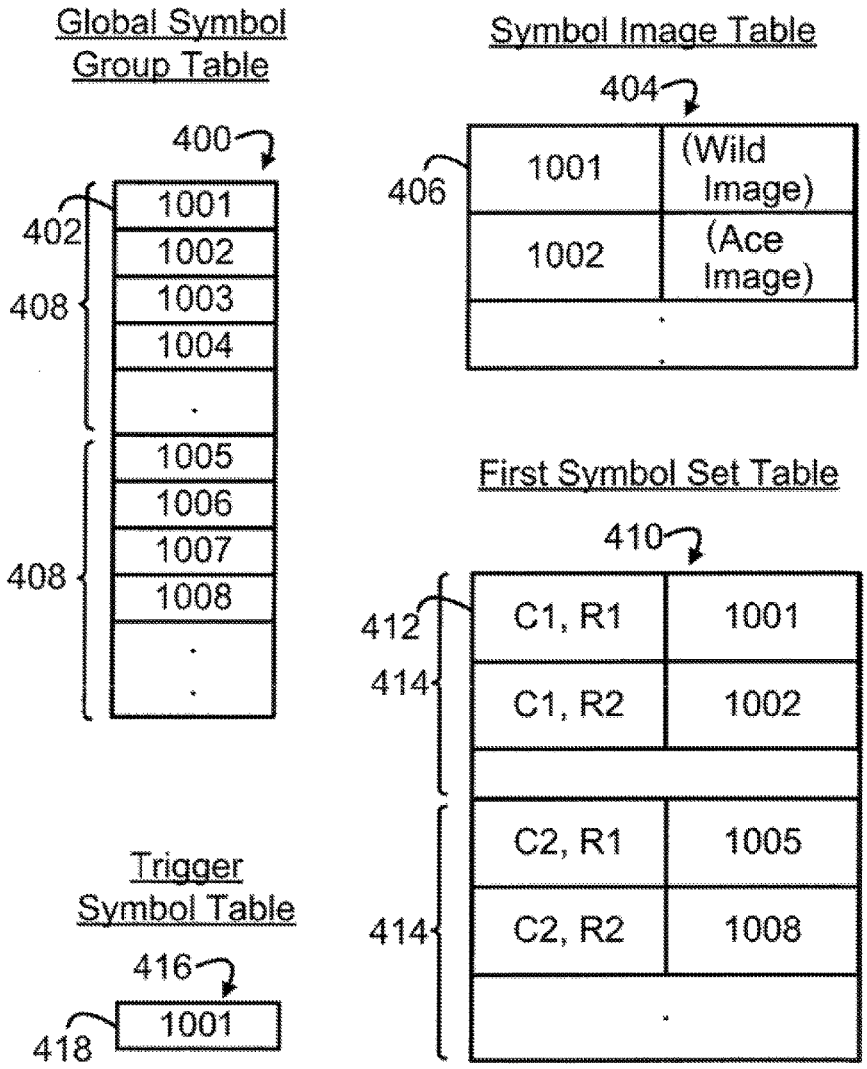
FIG. 4 depicts diagrams of tables that may be used with the processes, machines, and systems herein, in accordance with example embodiments.

In one example, the global symbol group may be represented as a table (or other data structure) stored in data storage 114. FIG. 4 shows an example global symbol group table 400. The global symbol group table 400 includes multiple records 402, each including an identifier (e.g., 1001, 1002, 1003 1004, etc.) that represents a particular symbol. In one example, the global symbol group, and therefore the global symbol table 400, may be divided into multiple sub-groups 408 as discussed in greater detail below.

The global symbol group table 400 may be used in connection with a symbol image table 404. The symbol image table 404 includes multiple records 406 (shown as distinct rows of table 404), each including an identifier that represents a particular symbol, and a corresponding displayable image. As such, the symbol image table 404 may be used to map an identifier in the global symbol group table 400 to a displayable image.

The selected first symbol set may be represented by a first symbol set table 410. The first symbol set table 410 includes multiple records 412 (shown as distinct rows in table 410), each record including an arrangement position of the symbol, and an identifier that represents the symbol. As such, each symbol in the selected first symbol set may correspond with a respective arrangement position in an arrangement (e.g. both a column number and a row number in a column-and-row arrangement). As an example, C1, R1, shown in the first symbol set table 410, represents a symbol position at column 1 (e.g., a left-most column of a plurality of columns in a symbol-display-portion 502 of display 110) and row 1 (e.g., a top row of a plurality of rows in a symbol-display-portion 502 of display 110). The column identifiers in table 410 (e.g., C1 and C2) can refer to columns in a symbol matrix or reels of a plurality of reels that can be spun.

In one example, machine 100 may select the first symbol set by iterating through each record 412 in the first symbol set table 410, and selecting a symbol identifier from among the symbol identifiers in the global symbol group table 400. In one example the symbol identifiers are numbers and machine 100 uses a random number generator to select such numbers, and therefore to randomly select symbols.

In one example, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play", namely those included in the selected first symbol set.

In one example, the first symbol set may be partially restricted. For instance, the first symbol set may include an instance of a predetermined symbol from the global symbol group, for example, a Wild symbol. In another example, the predetermined symbol may be in a subgroup of global symbol group table 400 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Further, a sub-group 408 may represent an ordering of symbols on a particular reel.

Returning to FIG. 3, block 306 includes displaying, by the machine 100 on the symbol-display-portion of the display 110, the selected first symbol set.

FIG. 6 shows an example of a first symbol set 600 from the global symbol group for display during a base outcome event. The displayed first symbol set 600 includes (i) a single Wild symbol at arrangement position C4,R2; (ii) three Ace symbols at arrangement positions C3,R1 and C3,R2 and C4,R3; (iii) a pair of King symbols at arrangement positions C1,R1 and C5,R2; (iv) three Queen symbols at arrangement positions C4,R1 and C5,R1 and C2,R3; (v) four Jack symbols at arrangement positions C2,R1 and C1,R2 and C2,R2 and C5,R3; and (vi) two Ten symbols at arrangement positions C1,R3 and C3,R3.

Next, block 308 includes making, by machine 100, a determination that a trigger event occurred. The trigger event can be a randomly occurring event, such as an event that randomly occurs during performance of at least some base outcome events. For example, occurrence of the trigger event can include the presence of at least one trigger symbol in the first symbol set, such as in connection with a previous play of the game (e.g., a base outcome event). In one example, the trigger symbol may be predetermined, for example a Wild symbol.

Making the determination that the trigger event occurred can take place while machine 100 operates in a first machine state (or more simply, the first state). Machine 100 can be configured such that, while machine 100 is operating in the first state, machine 100 allows the player to play base outcome events in which sets of symbols selected from a global symbol group can be selected by processor 112 and displayed by display 110.

In one example, the machine 100 may determine that the trigger event occurred by determining that the selected first symbol set includes the trigger symbol in one or more particular arrangement positions (e.g., in a middle row or a middle column). In some instances, the machine 100 may determine that the trigger event occurred by determining that the selected first symbol set includes two or more (of the same or different) trigger symbols, and potentially in one or more particular positions.

Figure 7:
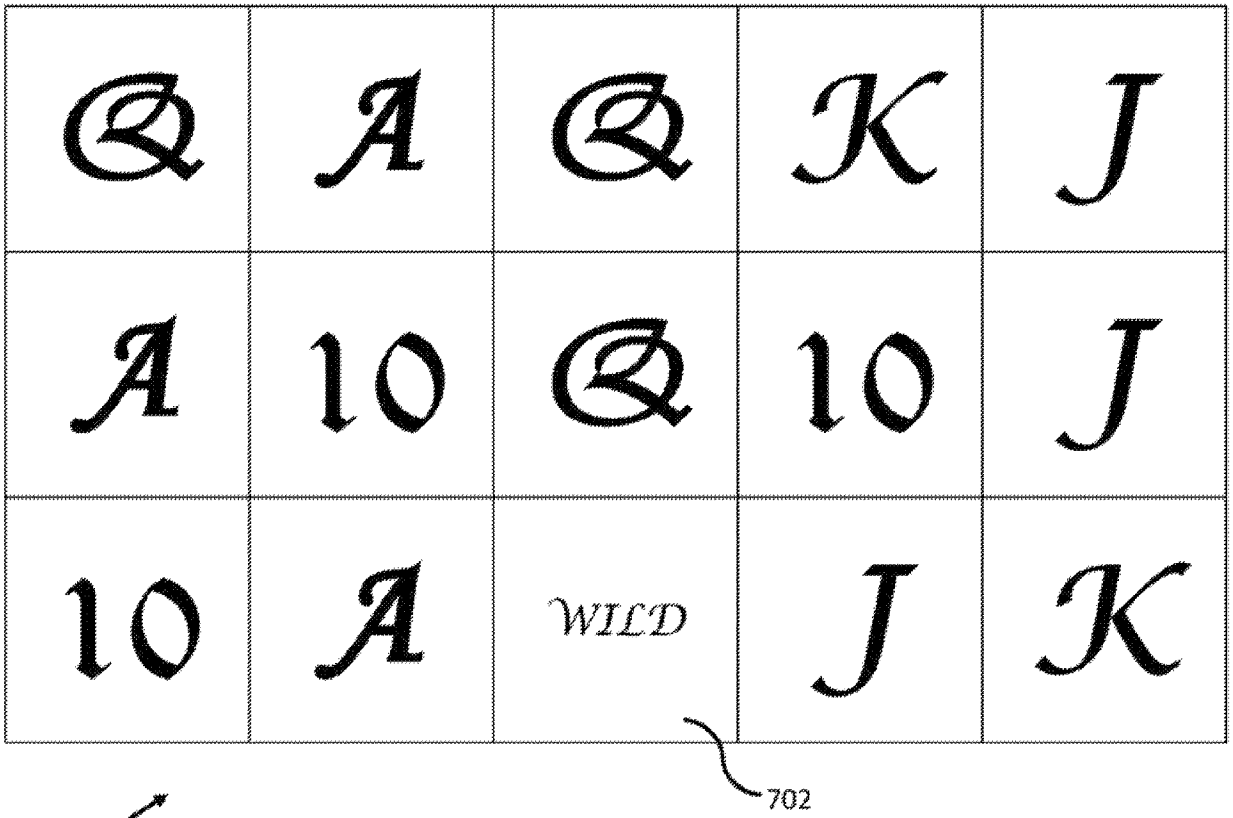
FIG. 7 depicts an example of another selected symbol set in a display, in accordance with example embodiments.

FIG. 7 shows an example of such a first symbol set selected from the global symbol group. The first symbol set 700 consists of (i) a single Wild symbol 702 at arrangement position C3,R3; (ii) three Ace symbols at arrangement positions C2,R1 and C1,R2 and C2,R3; (iii) two King symbols at arrangement positions C4,R1 and C5,R3; (iv) three Queen symbols at arrangement positions C1,R1 and C3,R1 and C3,R2; (v) three Jack symbols at arrangement positions C5,R1 and C5,R2 and C4,R3; and (vi) three Ten symbols at arrangement positions C2,R2 and C4,R2 and C1,R3.

In the example of FIG. 7, the trigger condition is the selection of a Wild symbol in the middle column of the symbol-display-portion of the display 110 of the machine 100, i.e. the selection of a Wild symbol in at least one arrangement position C3,R1, C3,R2 or C3,R3. The selection of Wild symbol 702 in the middle column of the symbol-display-portion of display 110 at arrangement position C3,R3 means that the trigger condition has occurred.

Returning now to FIG. 3, block 310 includes, pursuant to making the determination (i.e., the determination in block 308), amending, by the machine 100, the displayed first symbol set to include at least one instance of a predetermined symbol from the global symbol set so as to provide a winning symbol combination.

Figure 8:
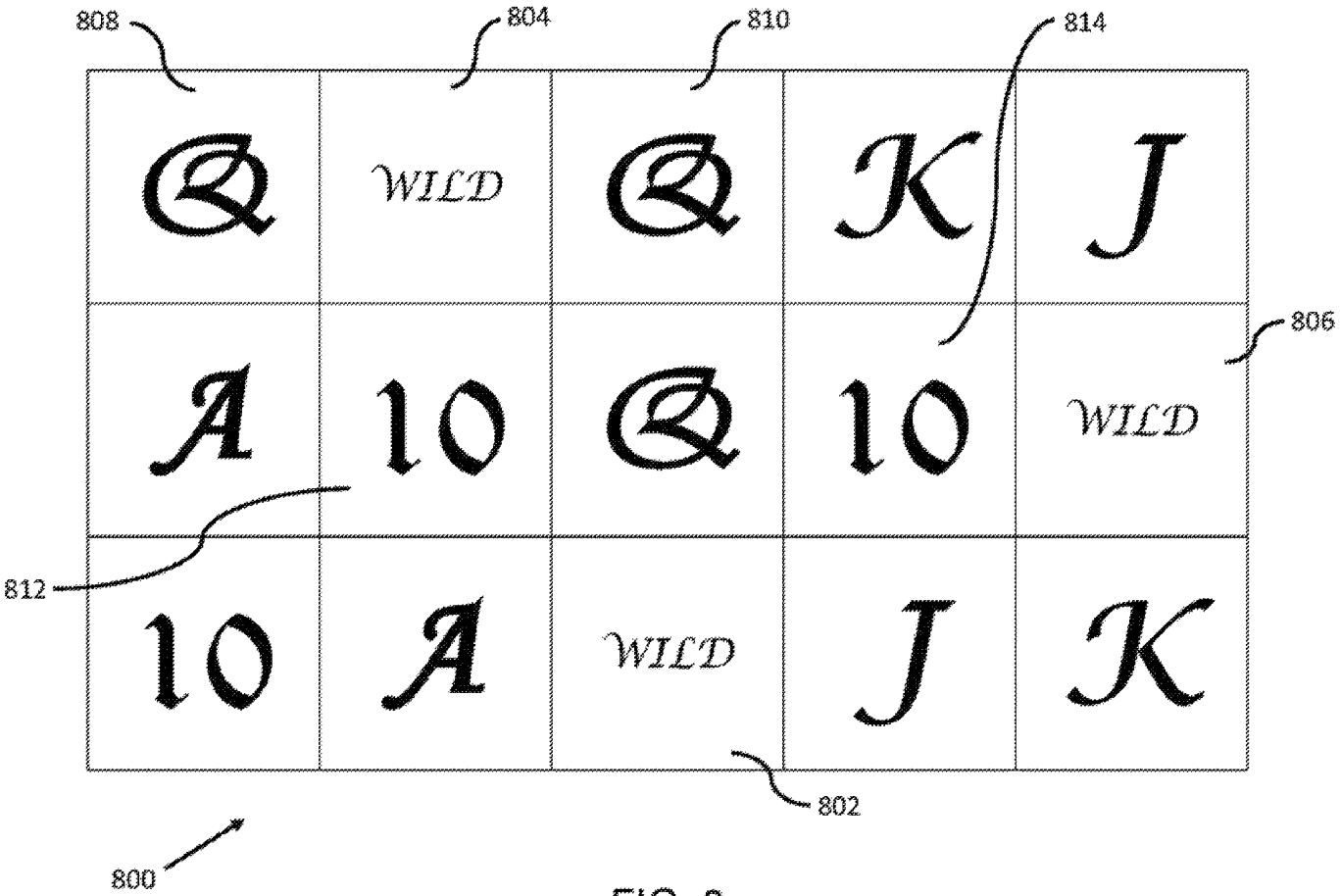
FIG. 8 depicts an example of an amended symbol set in a display, in accordance with example embodiments.

FIG. 8 represents the first symbol set of FIG. 7 after having been amended by the machine 100 pursuant to the occurrence of the trigger event represented in FIG. 7. Wild symbol 802 that gave rise to the trigger event in FIG. 7 (labelled 702 in FIG. 7), has remained unamended. The Ace symbol at arrangement position C2,R1 in FIG. 7 has been amended by processor 100 to a Wild symbol 804. In addition, Jack symbol at arrangement position C5,R2 has been amended by processor to a Wild symbol 806. Wild symbol 804 together with Queen symbols 808 and 810 are a winning symbol combination (i.e., three Queens), since a Wild symbol may substitute for any other symbol in the global symbol group. Similarly, Wild symbol 806 and the Ten symbols 812 and 814 are also a winning symbol combination (i.e., three Tens).

In one example, at least one amended symbol in the amended first symbol set will form part of a winning symbol combination, but not every amended symbol in the amended symbol set will necessarily form part of a winning symbol combination.

Next, block 312 includes determining, by machine 100, using a stored payout table (not shown), a first payout amount, where the first payout amount is a function of the selected first symbol set, and the received wager. Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected, or amended, for the outcome event (e.g., the first symbol set selected for the first outcome event) or the corresponding arrangements of symbols in the selected first symbol set.

Next, block 314, includes displaying, by display 110 of machine 100, the determined first payout amount. For example, where machine 100 has determined, using the stored payout table, a first payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

In one example, machine 100 may also physically dispense a corresponding payout (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

Machine 100 can cause symbol-display-segments to spin, and to cause spinning symbol-display-segments to stop spinning. The spinning and stopping of the spinning symbol-display-segments can be carried out for each outcome event. In accordance with the embodiments in which the symbol-display-portion 502 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

Notably, the operations of replacing, reordering, adding, and/or removing symbols from a reel of a reel-based game (e.g., the operations of blocks 310, 912, 1010, and 1108 as just some possible examples), necessitate computer implementation. In a mechanical reel-based game, the symbols appearing on each reel are fixed and cannot be changed mid-game. In contrast, the computer implementation herein allows the number of symbols per reel to be changed, as well as the symbols appearing on each reel to be replaced and/or re-ordered. These changes can occur mid-game, for example between spins of the reels. Consequently, these features of the disclosure herein would not exist but for computer technology.

Further, these features are an improvement to reel-based gaming technology. Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

IV. Additional Example Operations

Figure 9A:
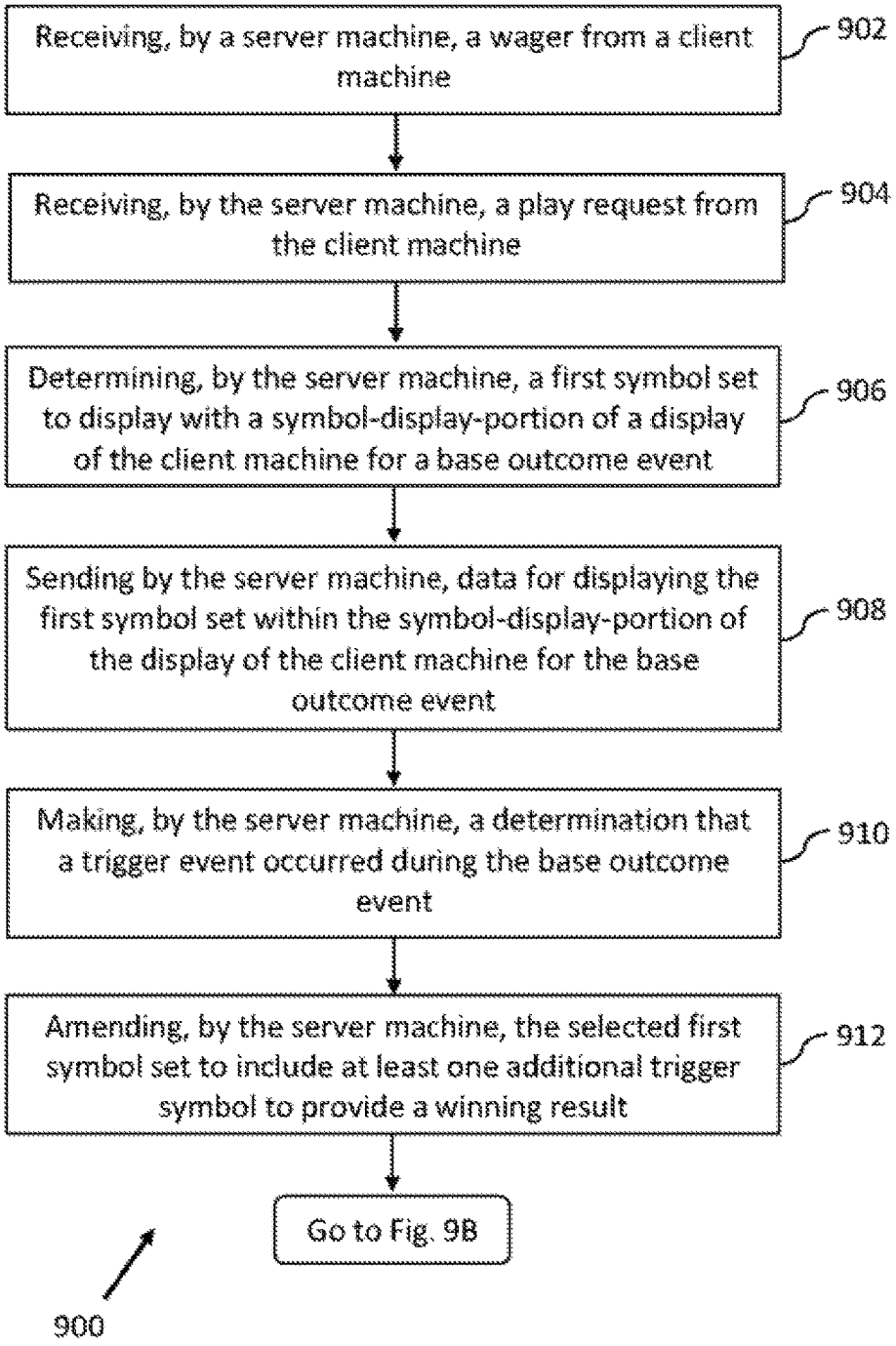
FIG. 9A is a first part of a flow chart, in accordance with example embodiments.
Figure 9B:
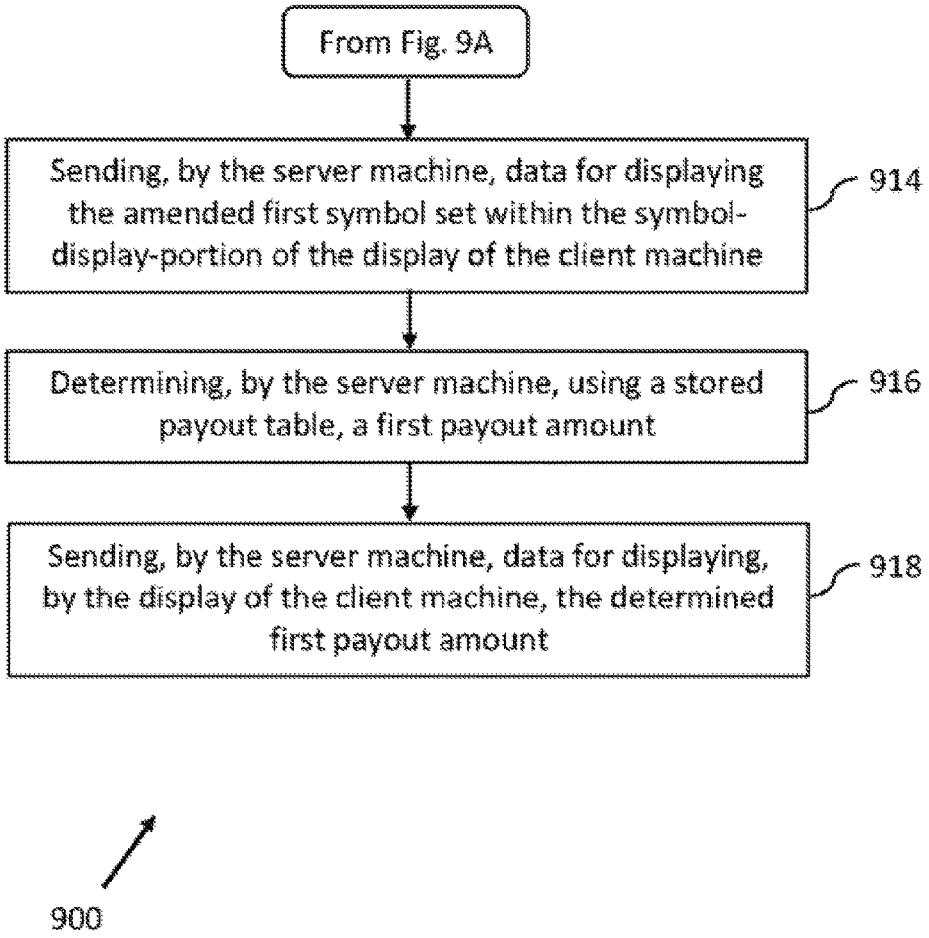
FIG. 9B is a second part of the flow chart of FIG. 9A, in accordance with example embodiments.

FIGS. 9A-9B depict a flowchart showing a set of operations 900 (or more simply, "the set 900") that can, for example, be carried out using server machine 100*a*. Note that several of the operations described in connection with FIG. 9A-9B parallel operations described in connection with FIG. 3. As such, variations of the operations described in connection with FIG. 3 are likewise applicable to the operations described in connection with Figures FIG. 9A-9B. However, for the sake of brevity, these variations are not repeated. The server machine 100*a*, in performing the set 900, can perform the operations described above with respect to machine 100.

Turning to FIG. 9A, block 902 includes receiving, by the server machine 100*a*, a wager from the client machine 100*b*.

Next, block 904 includes receiving, by the server machine 100*a*, a play request from the client machine 100*b*.

Next, block 906 includes determining, by the server machine 100*a*, a first symbol set to display within the symbol-display-portion of the display 110*b* of the client machine 100*b* for a base outcome event.

Next, block 908 includes sending, by the server machine 100*a*, data for displaying, by the display 110*b* of the client machine 100*b*, the first symbol set within the symbol-display-portion of the display.

Next, block 910 includes making, by the server machine 100*a*, a determination that a trigger event occurred during the base outcome event.

Next, block 912 includes amending, by the server machine 100*a*, the selected first symbol set to include at least one additional trigger symbol to provide a winning result.

Turning now to FIG. 9B, block 914 includes sending, by the server machine 100*a*, data for displaying, by the display 110*b* of the client machine 100*b*, the amended first symbol set within the symbol-display-portion of the display.

Next, block 916 includes determining, by the server machine 100*a* using a stored payout table, a first payout amount associated with the amended first symbol set.

Next, block 918 includes sending, by the server machine 100*a*, data for displaying, by the display 110*b* of the client machine 100*b*, the determined first payout amount.

Figure 10:
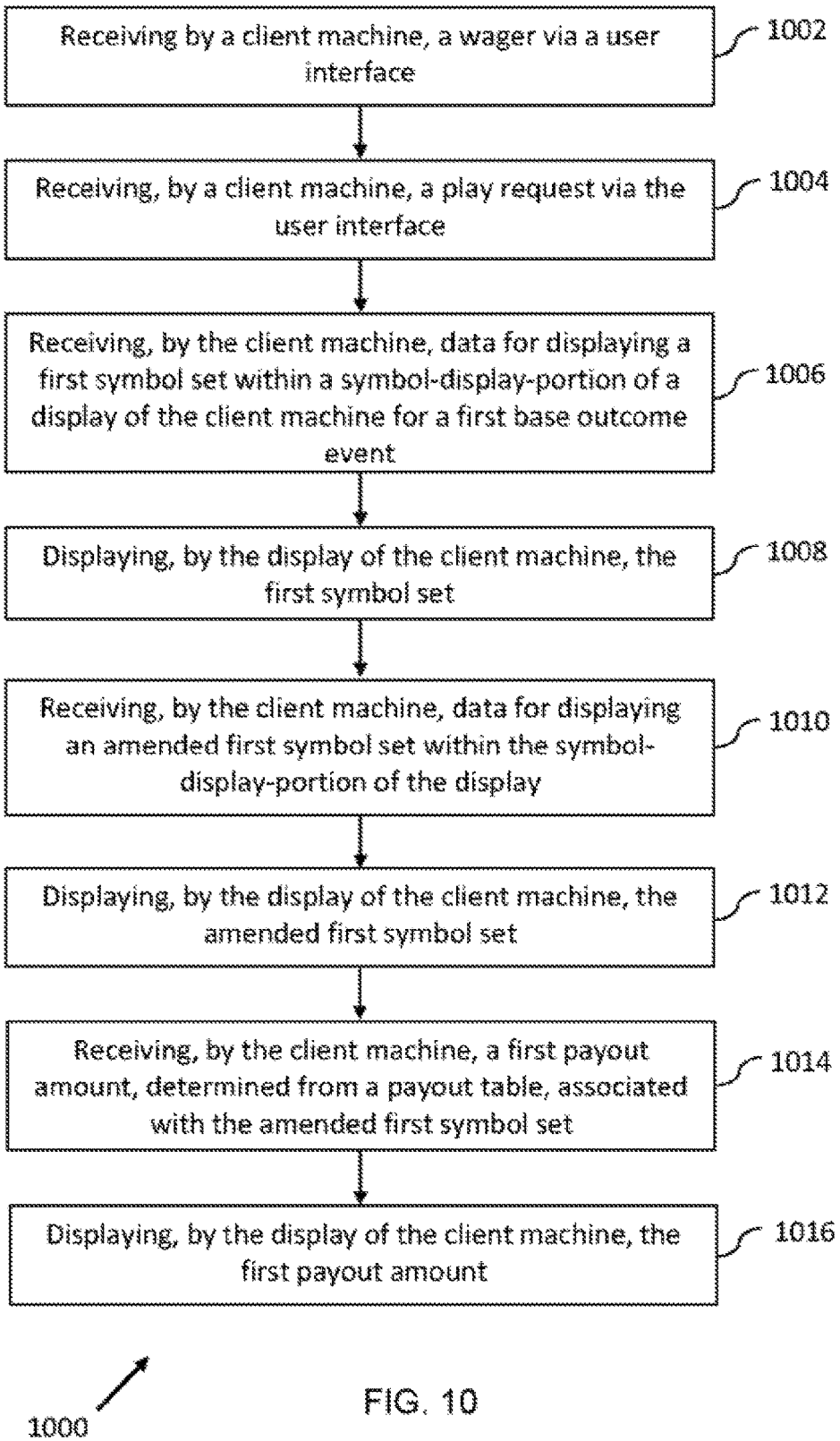
FIG. 10 is a flow chart, in accordance with example embodiments.

FIG. 10 depicts a flowchart showing a set of operations 1000 (or more simply, "the set 1000") that can, for example, be carried out using client machine 100*b*. Note that several of the operations described in connection with FIG. 10 parallel operations described in connection with FIG. 3 and FIGS. 9A-9B. As such, variations of the operations described in connection with FIG. 3 and FIGS. 9A-9B are likewise applicable to the operations described in connection with FIG. 10. However, for the sake of brevity, these variations are not repeated. The client machine 100*b*, in performing the set 1000, can perform the operations described above with respect to machine 100.

Turning to FIG. 10, block 1002 includes receiving, by the client machine 100*b*, a wager via the user interface 104*b*. Client machine 100*b* can transmit the received wager or data indicative thereof over the communication network 116 to server machine 100*a*.

Next, block 1004 includes receiving, by the client machine 100*b*, a play request via the user interface 104*b*. Client machine 100*b* can transmit the received play request or data indicative thereof over the communication network 116 to server machine 100*a*.

Next, block 1006 includes receiving, by the client machine 100*b*, data for displaying a first symbol set within the symbol-display-portion of the display 110*b* for a first base outcome event.

Next, block 1008 includes displaying, by the display 100*b* of the client machine 100*b*, the first symbol set.

Next, block 1010 includes receiving, by the client machine 100*b*, data for displaying an amended first symbol set within the symbol-display-portion of the display 110*b*.

Next, block 1012 includes displaying, by the display 100*b* of the client machine 100*b*, the amended first symbol set.

Next, block 1014 includes receiving, by the client machine 100*b*, a first payout amount, determined from a payout table, associated with the amended first symbol set.

Next, block 1016 includes displaying, by the display 110*b* of the client machine 100*b*, the determined first payout amount.

Figure 11:
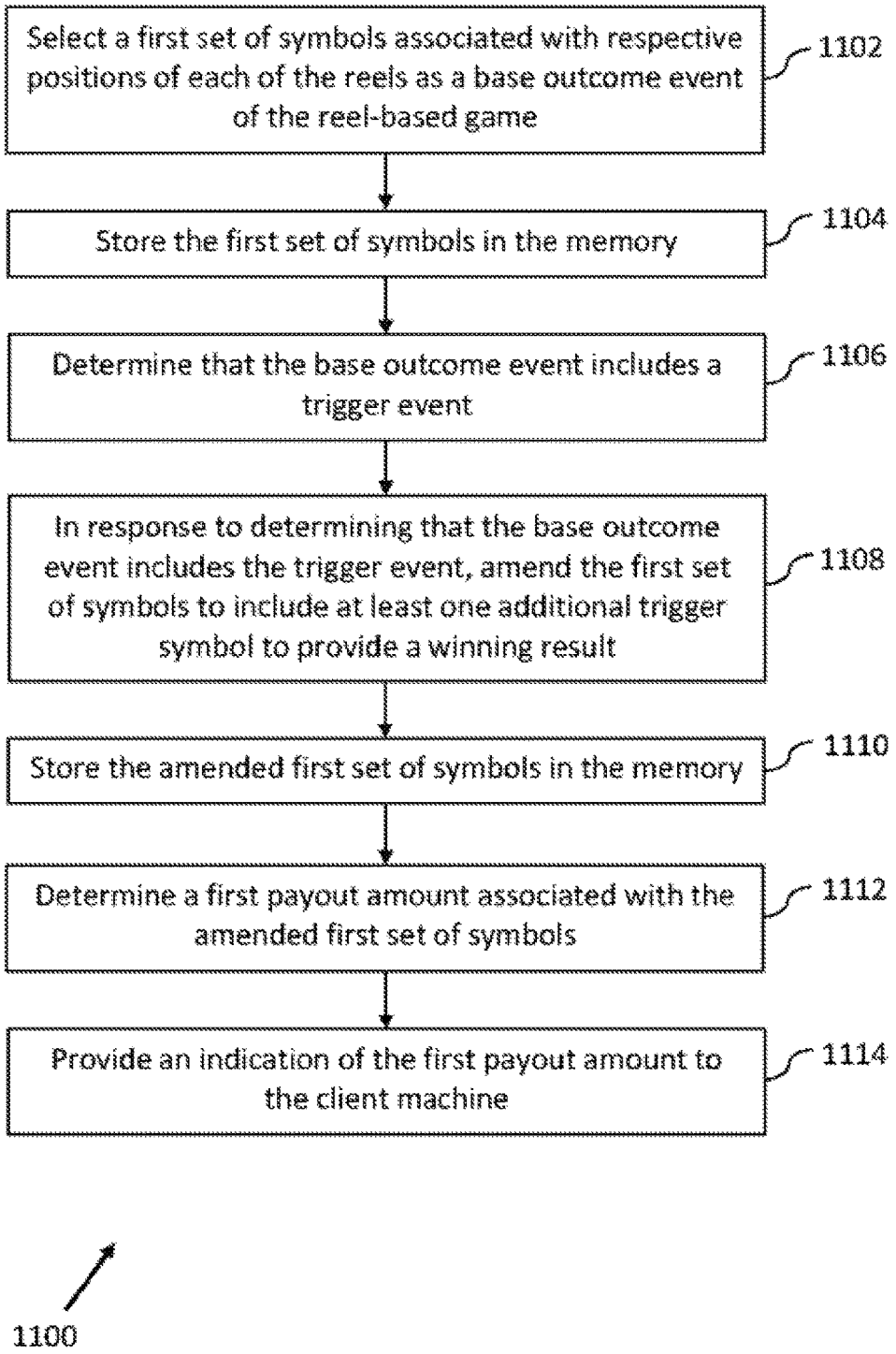
FIG. 11 is a flow chart, in accordance with example embodiments.

FIG. 11 depicts a flowchart showing a set of operations 1100 (or more simply, "the set 1100") that can, for example, be carried out using server machine 100*a* and/or client machine 100*b*. To the extent that a client machine carries out any of the set 1100, these operations may also include displaying various types of information, such as symbol sets, payout amounts, and so on. Note that several of the operations described in connection with FIG. 11 parallel operations described in connection with FIG. 3, FIGS. 9A-9B, and FIG. 10. As such, variations of the operations described in connection with FIG. 3, FIGS. 9A-9B, and FIG. 10 are likewise applicable to the operations described in connection with FIG. 11.

Turning to FIG. 11, block 1102 includes selecting a set of symbols (i.e., a first set of symbols) associated with respective positions of each of the reels as a base outcome event of the reel-based game.

Next, block 1104 includes storing the set of symbols in the memory.

Next, block 1106 includes determining that the base outcome event includes a trigger event. The trigger event may involve a predetermined symbol appearing on a designated reel, or in a designated row and/or column of the display.

Next, block 1108 includes, responsive to determining that the base outcome event includes the trigger event, amending the set of symbols to include at least one additional trigger symbol to provide a winning result.

Next, block 1110 includes storing the amended set of symbols in the memory.

Next, block 1112 includes determining a payout amount (i.e., a first payout amount) associated with the amended set of symbols.

Next, block 1114 includes providing an indication of the payout amount to the client machine.

In some embodiments, the respective pluralities of symbols for the reels may be arranged in respective cyclical sequences of symbols. Selecting the set of symbols may involve, for each reel, randomly selecting a respective reel position such that a respective subsequence of the symbols thereon are in the set of symbols. Selecting the set of symbols may involve simulating spins of the plurality of reels. The reel-based game may have five reels and each of the five reels may contribute three symbols to the set of symbols. Other arrangements are possible.

In some embodiments, the trigger event may involve the set of symbols including at least n trigger symbols. The value of n may be, 1, 2, 3, and so on. The trigger symbol may be the Wild symbol. The predetermined symbol may also be a Wild symbol.

In some embodiments, selecting the set of symbols may involve transmitting, to the client machine, a representation of the set of symbols. Reception of the set of symbols may cause the client machine to display a spin of the plurality of reels resulting in the set of symbols. Replacing the one or more symbols in the set of symbols with predetermined symbols may involve transmitting, to the client machine, a representation of the set of symbols after replacement. Reception of the set of symbols after replacement may cause the client machine to display a spin of the plurality of reels resulting in the set of symbols after replacement. Alternatively or additionally, replacing the one or more symbols in the set of symbols with predetermined symbols may involve causing the client machine to display an animation in which the predetermined symbols that replace the one or more symbols move from an arrangement position of the predetermined symbol in the designated reel to their respective arrangement positions.

Figure 12:
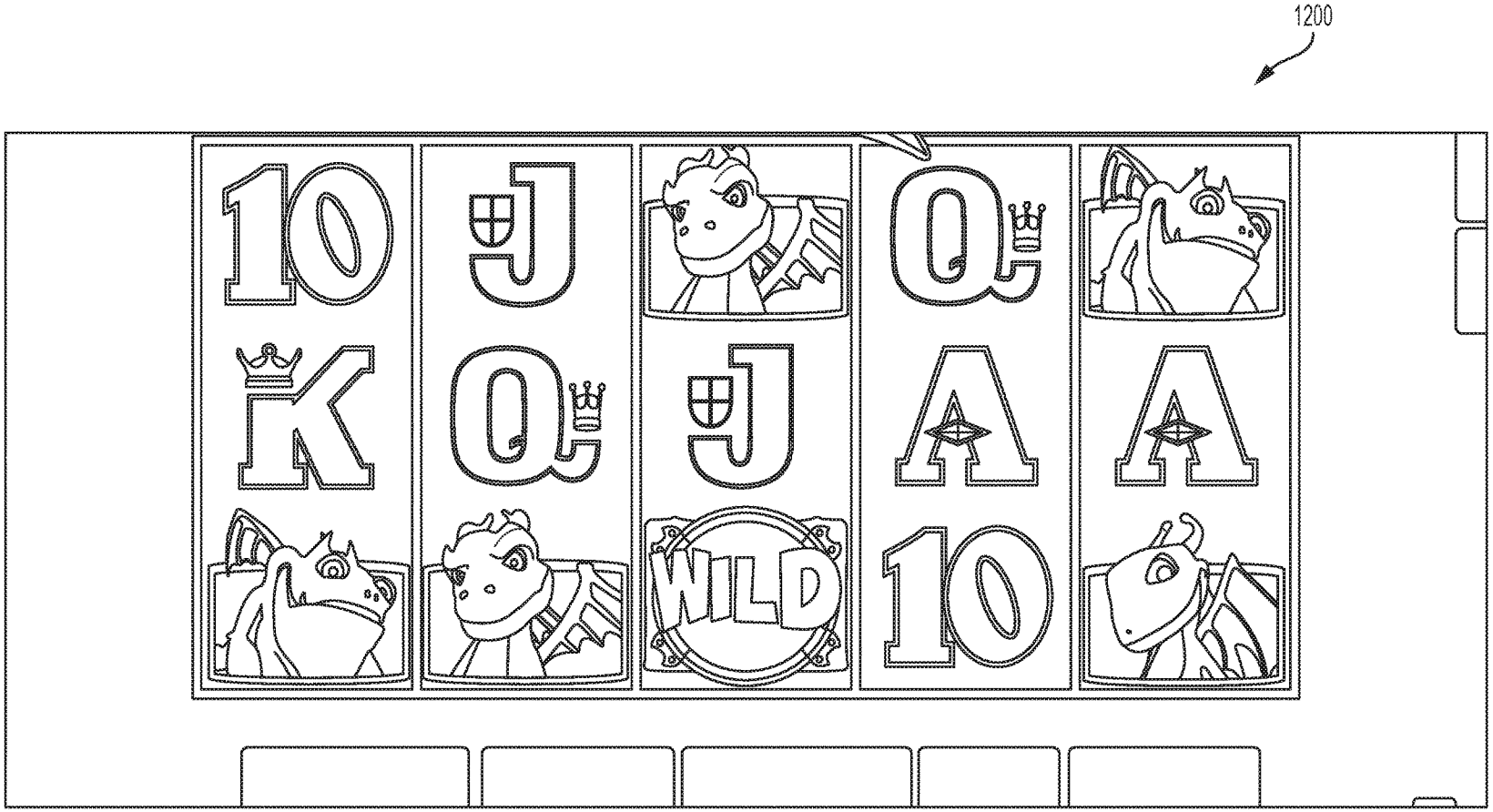
FIG. 12 depicts elements displayable by a display of a machine, in accordance with example embodiments.
Figure 13:
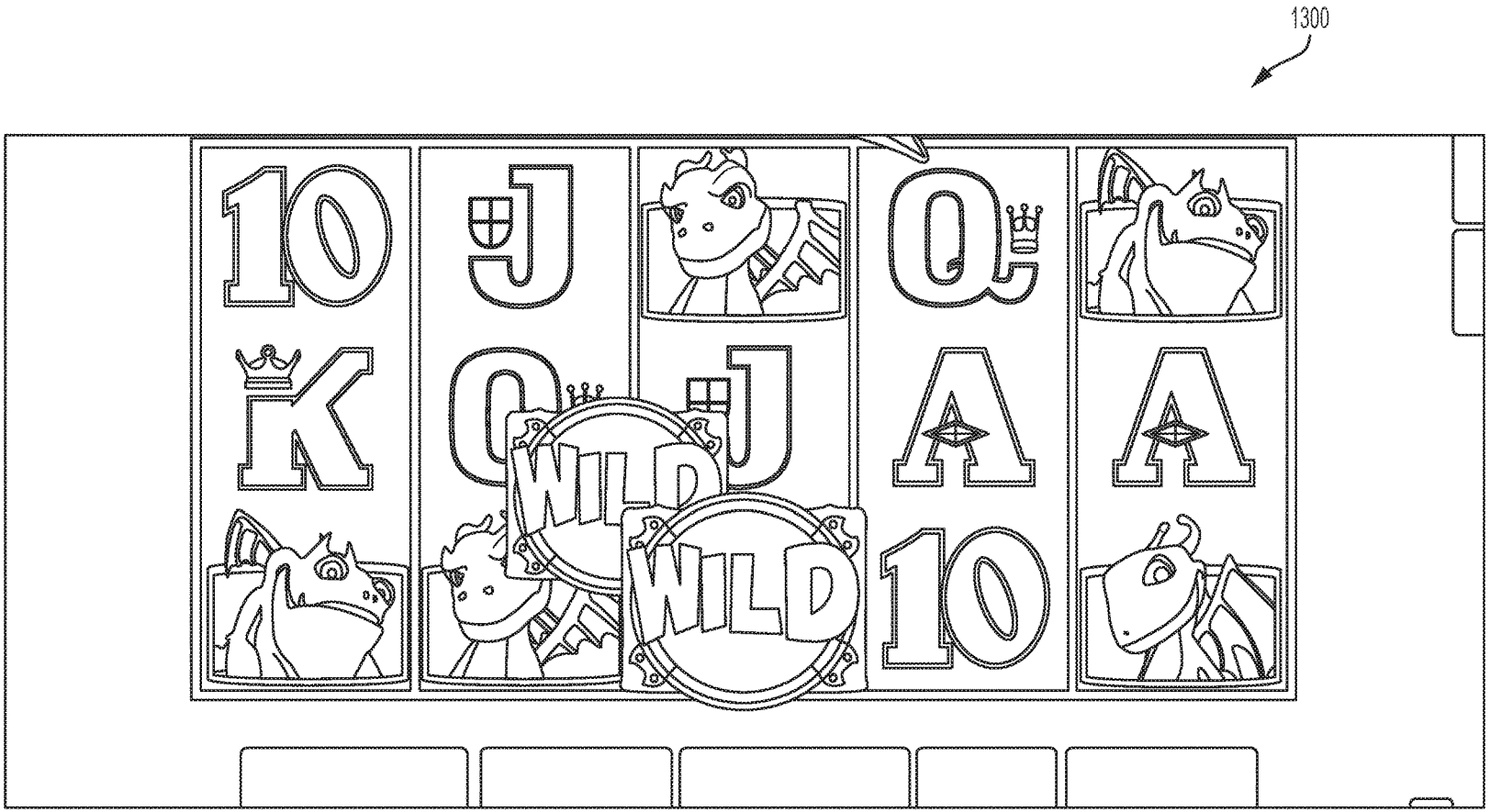
FIG. 13 depicts elements displayable by a display of a machine, in accordance with example embodiments.
Figure 14:
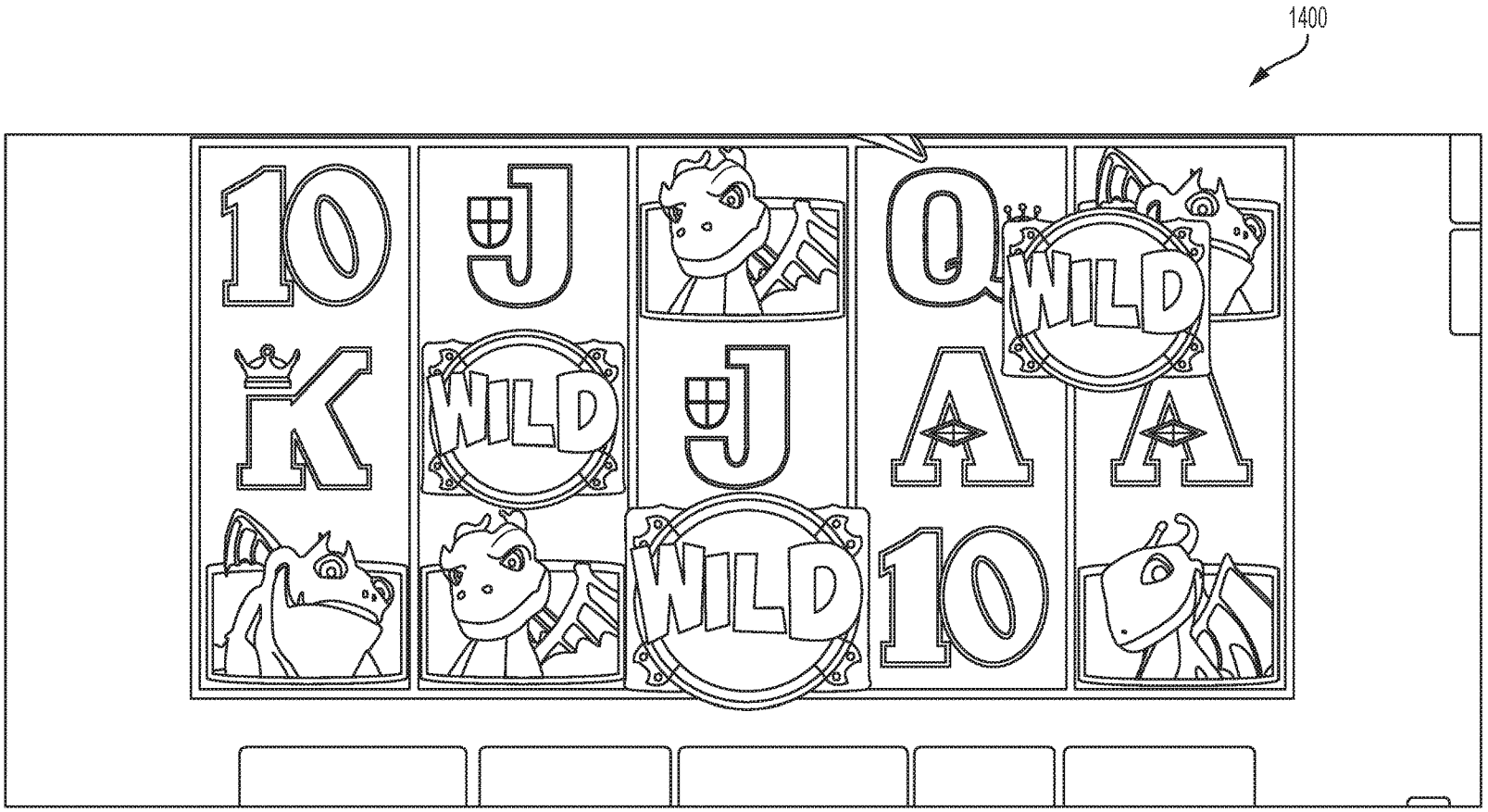
FIG. 14 depicts elements displayable by a display of a machine, in accordance with example embodiments.
Figure 15:
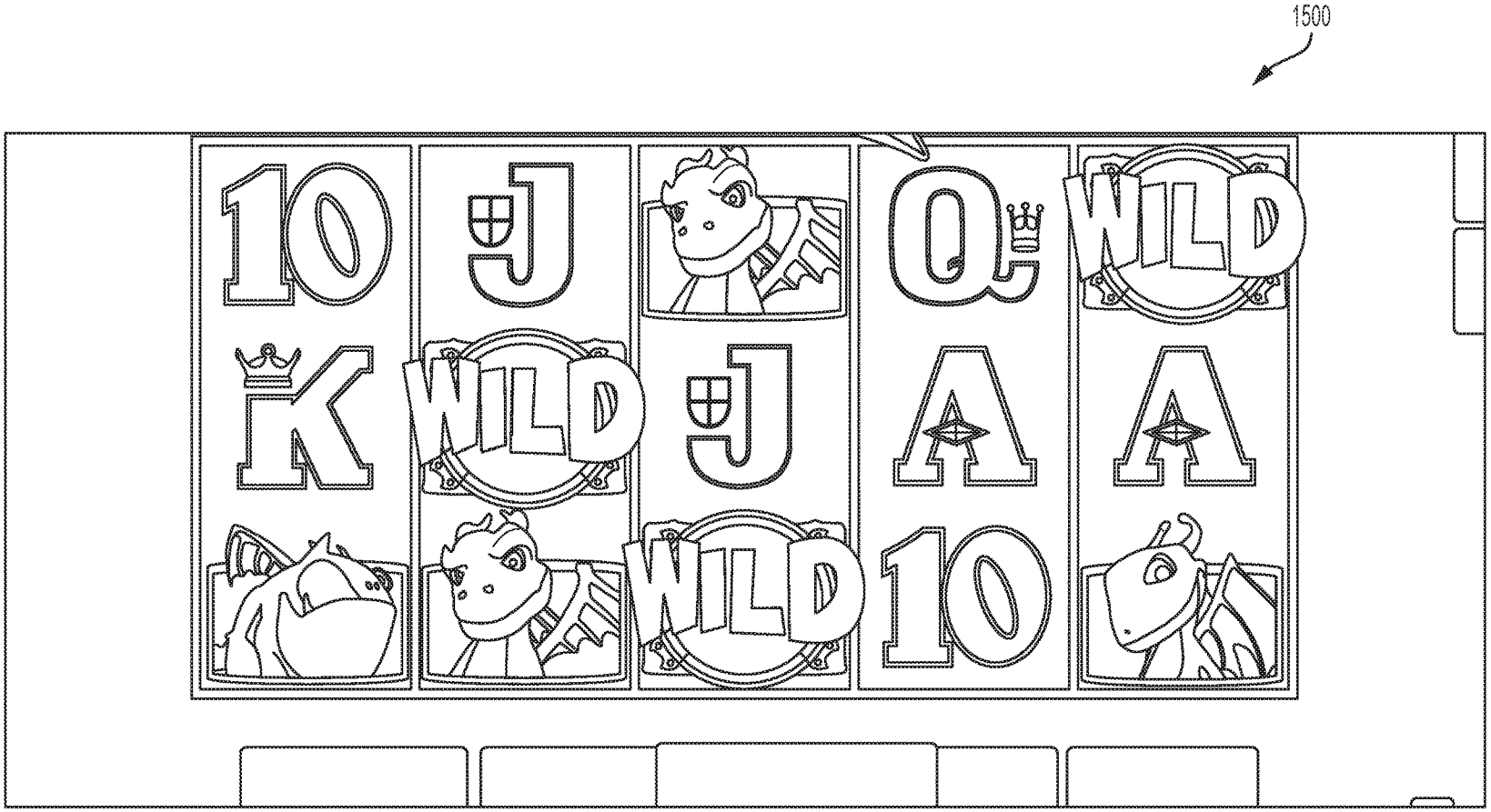
FIG. 15 depicts elements displayable by a display of a machine, in accordance with example embodiments.

FIGS. 12, 13, 14, and 15 provide an example of such animation. In FIG. 12, display 1200 depicts a predetermined (Wild) symbol appearing at arrangement position C3,R3 on a five-column, three-row matrix of symbols. In display 1200, the middle reel is the designated reel. In FIG. 13, display 1300 depicts another predetermined symbol propagating from arrangement position C3,R3 to arrangement position C2,R2. In FIG. 14, display 1400 depicts yet another predetermined symbol propagating from arrangement position C3,R3 to arrangement position C5,R1. In FIG. 15, display 1500 depicts the three predetermined symbols, appearing at arrangement positions C2,R2, C3,R3, and C5,R1, as part of a winning combination.

In some embodiments, the operations may further involve determining a payout amount associated with the symbol set after replacement, and transmitting, to the client machine, an indication of the payout amount. The payout amount may be based on the predetermined symbol in the designated reel and at least one of the predetermined symbols that replace the one or more symbols. The client machine may be associated with a credit account. The credit account may be debited to play the reel-based game and credited by the payout amount.

In some embodiments, at least one of the predetermined symbols that replace the one or more symbols does not contribute to the winning combination.

In some embodiments, the designated reel is a middle reel of the plurality of reels. For instance, if there are three reels, the middle reel may be the reel that is second-most from the left and the right. In another example, if there are five reels, the middle reel may be the reel that is third-most from the left and the right.

Some embodiments may involve simultaneously executing reel-based games in real time on behalf of at least 30 client machines, where each of the at least 30 client machines communicates with the one or more processors by way of a wide-area packet-switched network. In some cases, the one or more processors may simultaneously execute reel-based games in real time on behalf of more or fewer than 30 client machines. For instance, this simultaneous execution may involve 10, 20, 50, 100, or 1000 client machines, or another extent of client machines.

Particularly, simultaneous execution of such a large number of reel-based games in real time necessitates computer implementation. When taking part in an online game, such as the reel-based games disclosed herein, players expect results of reel spin or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of reel-based games in real time would not exist but for computer implementation thereof.

The client machine may include the one or more processors and the memory.

V. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method comprising:

selecting, by one or more processors of a gaming machine, a set of symbols associated with an outcome event of a reel-based game, wherein the reel-based game is executed on behalf of a client machine, wherein selecting the set of symbols involves spinning a plurality of reels to determine the outcome event, and wherein a memory stores respective pluralities of symbols for the reels;

storing, by the one or more processors, the set of symbols in the memory;

determining, by the one or more processors, that the set of symbols includes a predetermined symbol on a designated reel and does not include any winning combination;

in response to determining that the set of symbols includes the predetermined symbol on the designated reel and does not include any winning combination, replacing, by the one or more processors, one or more symbols in the set of symbols with predetermined symbols such that the symbol set after replacement includes a winning combination; and storing, by the one or more processors, the set of symbols after replacement in the memory.

2. The method of claim 1, wherein the predetermined symbol is a Wild symbol.

3. The method of claim 1, wherein each reel comprises a respective cyclical sequence of symbols, and wherein selecting the set of symbols comprises:

for each reel, randomly selecting a respective reel position that displays a subsequence of the symbols on the reel that are part of the set of symbols.

4. The method of claim 1, wherein selecting the set of symbols comprises:

simulating a spin of all reels, resulting in the set of symbols.

5. The method of claim 1, wherein selecting the set of symbols comprises:

transmitting, to the client machine, a representation of the set of symbols, wherein reception of the set of symbols causes the client machine to display a spin of the plurality of reels resulting in the set of symbols.

6. The method of claim 1, wherein replacing the one or more symbols in the set of symbols with predetermined symbols comprises:

transmitting, to the client machine, a representation of the set of symbols after replacement, wherein reception of the set of symbols after replacement causes the client machine to display a spin of the plurality of reels resulting in the set of symbols after replacement.

7. The method of claim 1, wherein replacing the one or more symbols in the set of symbols with predetermined symbols comprises:

causing the client machine to display an animation in which the predetermined symbols that replace the one or more symbols move from an arrangement position of the predetermined symbol in the designated reel to their respective arrangement positions.

8. The method of claim 1, wherein the reel-based game has five reels and each of the five reels displays three symbols at a time.

9. The method of claim 1, wherein the operations further comprise:

determining a payout amount associated with the symbol set after replacement; and transmitting, to the client machine, an indication of the payout amount.

10. The method of claim 9, wherein the payout amount is based on the predetermined symbol in the designated reel and at least one of the predetermined symbols that replace the one or more symbols.

11. The method of claim 9, wherein the client machine is associated with a credit account, and wherein the credit account is debited to play the reel-based game and credited by the payout amount.

12. The method of claim 1, wherein the gaming machine simultaneously executes reel-based games in real time on behalf of at least 30 client machines, and wherein each of the at least 30 client machines communicates with the gaming machine by way of a wide-area packet-switched network.

13. The method of claim 1, wherein at least one of the predetermined symbols that replace the one or more symbols does not contribute to the winning combination.

14. The method of claim 1, wherein the designated reel is a middle reel of the plurality of reels.

15. An article of manufacture including a non-transitory computer-readable medium, having stored thereon program instructions that, upon execution by a gaming machine, cause the gaming machine to perform operations comprising:

selecting a set of symbols associated with an outcome event of a reel-based game, wherein the reel-based game is executed on behalf of a client machine, wherein selecting the set of symbols involves spinning a plurality of reels to determine the outcome event, and wherein a memory of the gaming machine stores respective pluralities of symbols for the reels;

storing the set of symbols in a memory;

determining that the set of symbols includes a predetermined symbol on a designated reel and does not include any winning combination;

in response to determining that the set of symbols includes the predetermined symbol on the designated reel and does not include any winning combination, replacing one or more symbols in the set of symbols with predetermined symbols such that the symbol set after replacement includes a winning combination; and storing the set of symbols after replacement in the memory.

16. The article of manufacture of claim 15, wherein selecting the set of symbols comprises:

simulating a spin of all reels, resulting in the set of symbols.

17. The article of manufacture of claim 15, wherein selecting the set of symbols comprises:

transmitting, to the client machine, a representation of the set of symbols, wherein reception of the set of symbols causes the client machine to display a spin of the plurality of reels resulting in the set of symbols.

18. The article of manufacture of claim 15, wherein replacing the one or more symbols in the set of symbols with predetermined symbols comprises:

transmitting, to the client machine, a representation of the set of symbols after replacement, wherein reception of the set of symbols after replacement causes the client machine to display a spin of the plurality of reels resulting in the set of symbols after replacement.

19. The article of manufacture of claim 15, wherein replacing the one or more symbols in the set of symbols with predetermined symbols comprises:

causing the client machine to display an animation in which the predetermined symbols that replace the one or more symbols move from an arrangement position of the predetermined symbol in the designated reel to their respective arrangement positions.

20. A gaming system configured for symbol replacement in a reel-based game, wherein the reel-based game is executed on behalf of a client machine, wherein the reel-based game involves spinning a plurality of reels to determine outcome events, the gaming system comprising:

a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account;

one or more gaming device processors; and one or more gaming device memory devices storing (i) respective pluralities of symbols for the reels and (ii) a plurality of gaming device instructions executable by the one or more gaming device processors to perform operations comprising:

selecting a set of symbols associated with an outcome event of the reel-based game, wherein selecting the set of symbols involves spinning the plurality of reels to determine the outcome event;

storing the set of symbols in the one or more gaming device memory devices;

determining that the set of symbols includes a predetermined symbol on a designated reel and does not include any winning combination;

in response to determining that the set of symbols includes the predetermined symbol on the designated reel and does not include any winning combination, replacing one or more symbols in the set of symbols with predetermined symbols such that the symbol set after replacement includes a winning combination; and storing the set of symbols after replacement in the one or more gaming device memory devices.

* * * * *